US007382999B2

(12) United States Patent
Takahashi

(10) Patent No.: US 7,382,999 B2
(45) Date of Patent: Jun. 3, 2008

(54) IMAGE FORMING APPARATUS WITH DETACHABLE UNITS

(75) Inventor: Mitsuru Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 299 days.

(21) Appl. No.: 11/223,101

(22) Filed: Sep. 12, 2005

(65) Prior Publication Data

US 2006/0072929 A1 Apr. 6, 2006

(30) Foreign Application Priority Data

| | | |
|---|---|---|
| Sep. 17, 2004 | (JP) | 2004-271480 |
| Sep. 17, 2004 | (JP) | 2004-271481 |
| Oct. 6, 2004 | (JP) | 2004-293716 |
| Oct. 6, 2004 | (JP) | 2004-293717 |
| May 31, 2005 | (JP) | 2005-159076 |

(51) Int. Cl.
*G03G 15/00* (2006.01)

(52) U.S. Cl. ..... 399/110; 399/113; 399/121; 399/123

(58) Field of Classification Search ..... 399/130, 399/110, 121, 123, 345, 113, 302, 308, 343, 399/358, 360

See application file for complete search history.

(56) References Cited

U.S. PATENT DOCUMENTS

| | | | | |
|---|---|---|---|---|
| 4,640,608 | A * | 2/1987 | Higaya et al. | 399/345 |
| 4,791,454 | A * | 12/1988 | Takahashi et al. | 399/113 |
| 4,860,056 | A * | 8/1989 | Kano et al. | |
| 4,943,828 | A * | 7/1990 | Manabe et al. | 399/113 |
| 4,952,974 | A | 8/1990 | Mori | |
| 5,041,872 | A * | 8/1991 | Nukaya et al. | 399/110 |
| 5,371,575 | A * | 12/1994 | Sekino et al. | 399/113 |
| 6,704,528 | B1 * | 3/2004 | Kawamura et al. | 399/123 |
| 2003/0059230 | A1 | 3/2003 | Yokoi et al. | |
| 2003/0147678 | A1 * | 8/2003 | Ozawa et al. | 399/302 |

FOREIGN PATENT DOCUMENTS

| | | |
|---|---|---|
| EP | 1637937 A2 * | 3/2006 |
| JP | 59195263 A * | 11/1984 |

(Continued)

OTHER PUBLICATIONS

U.S. Appl. No. 11/739,391, filed Apr. 24, 2007, Yokokawa et al.

(Continued)

*Primary Examiner*—David M. Gray
*Assistant Examiner*—Laura K Roth
(74) *Attorney, Agent, or Firm*—Oblon, Spivak, McClelland, Maier & Neustadt, P.C.

(57) ABSTRACT

An image forming apparatus can easily attach or detach a plurality of attachable and detachable units to or from the apparatus main body as a single unit or individually. An intermediate transfer apparatus is supported on a left guide rail and a right guide rail, and is attachable to and detachable from the image forming apparatus main body. A cleaning apparatus that cleans the intermediate transfer belt of the intermediate transfer apparatus is supported by an upper rail and a lower rail so as to be attachable to and detachable from the intermediate transfer apparatus. The detachment direction of the intermediate transfer apparatus and the direction of detachment of the cleaning apparatus are configured to be the same.

42 Claims, 15 Drawing Sheets

FOREIGN PATENT DOCUMENTS

| | | |
|---|---|---|
| JP | 7-270475 | 10/1995 |
| JP | 9-68848 | 3/1997 |
| JP | 2000-338744 | 12/2000 |
| JP | 2001-343838 | 12/2001 |
| JP | 2003-202728 | 7/2003 |
| JP | 2003-216001 | 7/2003 |
| JP | 2005181820 A * | 7/2005 |

OTHER PUBLICATIONS

U.S. Appl. No. 11/608,008, filed Dec. 7, 2006, Katoh et al.
U.S. Appl. No. 11/588,340, filed Oct. 27, 2006, Saeki et al.
U.S. Appl. No. 11/471,599, filed Jun. 21, 2006, Saeki et al.

* cited by examiner 10, 20
47
1
51
52

10, 20
47
52
52a

DETECTION LIGHT
53b

DETECTION LIGHT
53b
LOCK DETECTION
54
53a
53
53b

IMAGE FORMING APPARATUS WITH DETACHABLE UNITS

BACKGROUND OF THE INVENTION

1. Field of the Invention

The present invention relates to an image forming apparatus using an electronic photographic system such as a copier, printer or facsimile machine, and more particularly to an image forming apparatus having a belt unit that can be attached to and detached from the main body of the apparatus.

2. Description of the Related Art

There are image forming apparatuses used in an electronic photographic system configured such that a toner image formed on an image support member is transferred to recording paper as the paper is being transported by a belt-shaped transport apparatus (called a transfer belt or a transport belt). Moreover, apparatuses that transfer a toner image formed on an image support member to paper through an intermediate transfer belt are also well known.

Belt members such as these transfer belts or intermediate transfer belts are consumable parts, and the unit comprising the belt member, specifically, the belt apparatus can be attached to and detached from the image forming apparatus main body for replacement when the operating life is finished. In addition, normally, a cleaning apparatus is installed for cleaning toner and paper dust adhering to the belt, and this cleaning apparatus is also often set up to be attached to and detached from the image forming apparatus main body together with the belt apparatus. For example, disclosed in Japanese Unexamined Patent Application Publication 2000-338744 is a simplification of the replacement procedure by replacing the intermediate transfer belt, which is a belt apparatus, together with the cleaning apparatus thereof as a single unit.

In this regard, when comparing the operational life of a belt member such as a transfer belt or an intermediate transfer belt with that of a cleaning member, the belt member generally has a longer operational life. Thus, there have been proposals such as Japanese Unexamined Patent Application Publication 2001-343838 that are configured such that the belt apparatus and the cleaning apparatus can be separately replaced according to operational life thereof.

Nonetheless, as described in paragraph [0066] of the Description of Japanese Unexamined Patent Application. Publication 2001-343838, the cleaning apparatus (neutralization cleaning apparatus 100=first container 103) is secured to the belt apparatus (transport unit 20A) with screws, and the cleaning apparatus cannot be attached and detached without first removing the belt apparatus from the image forming apparatus main body. For this reason, there is the problem of having to spend the time and labor to remove the belt apparatus even when replacing just the cleaning member, which has a shorter operating life than the belt member.

In addition, when removing the cleaning apparatus from the image forming apparatus main body or form the belt apparatus, the cleaning apparatus is tilted and the collected toner, etc. spills. In conventional image forming apparatuses, including Japanese Unexamined Patent Application Publication 2001-343838, there was the problem that the interior or surroundings of the image forming apparatus, or the hands or clothing of the user would be soiled by toner, etc falling from the cleaning apparatus unless measures were taken to prevent toner, etc. from falling out when detaching the cleaning apparatus.

Further, there was the problem in conventional apparatuses that sometimes the units were accidentally dropped during replacement, and replacing (detaching) the units was not easy.

Technologies relating to the present invention are also disclosed for example in Japanese Unexamined Patent Application Publication 2003-202728.

SUMMARY OF THE INVENTION

It is an object of the present invention to provide an image forming apparatus that resolves the problems of conventional image forming apparatuses described above, and provide an image forming apparatus to the main body of which a plurality of attachable and detachable units can each be easily attached and detached.

In addition, another object of the present invention is to provide an image forming apparatus that can prevent recovered toner, etc. from dropping during detachment of the cleaning apparatus, and that makes detaching the cleaning apparatus easy.

Moreover, another object of the present invention is to provide an image forming apparatus that can prevent accidentally dropping units during unit replacement, and that improves the handling characteristics when replacing (detaching) a unit.

An image forming apparatus of the present invention comprises a first unit that can be attached to and detached from an apparatus main body and a second unit that can be attached to and detached from the first unit. The second unit can be attached to and detached from the apparatus main body integrally with the first unit, and also can be attached to and detached from the first unit with the first unit remaining mounted in the apparatus main body.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Embodiments of the present invention will be explained in detail below based on the diagrams.

First, an image forming apparatus with an attachable and detachable intermediate transfer apparatus of a first embodiment of the present invention will be explained.

Figure 1:
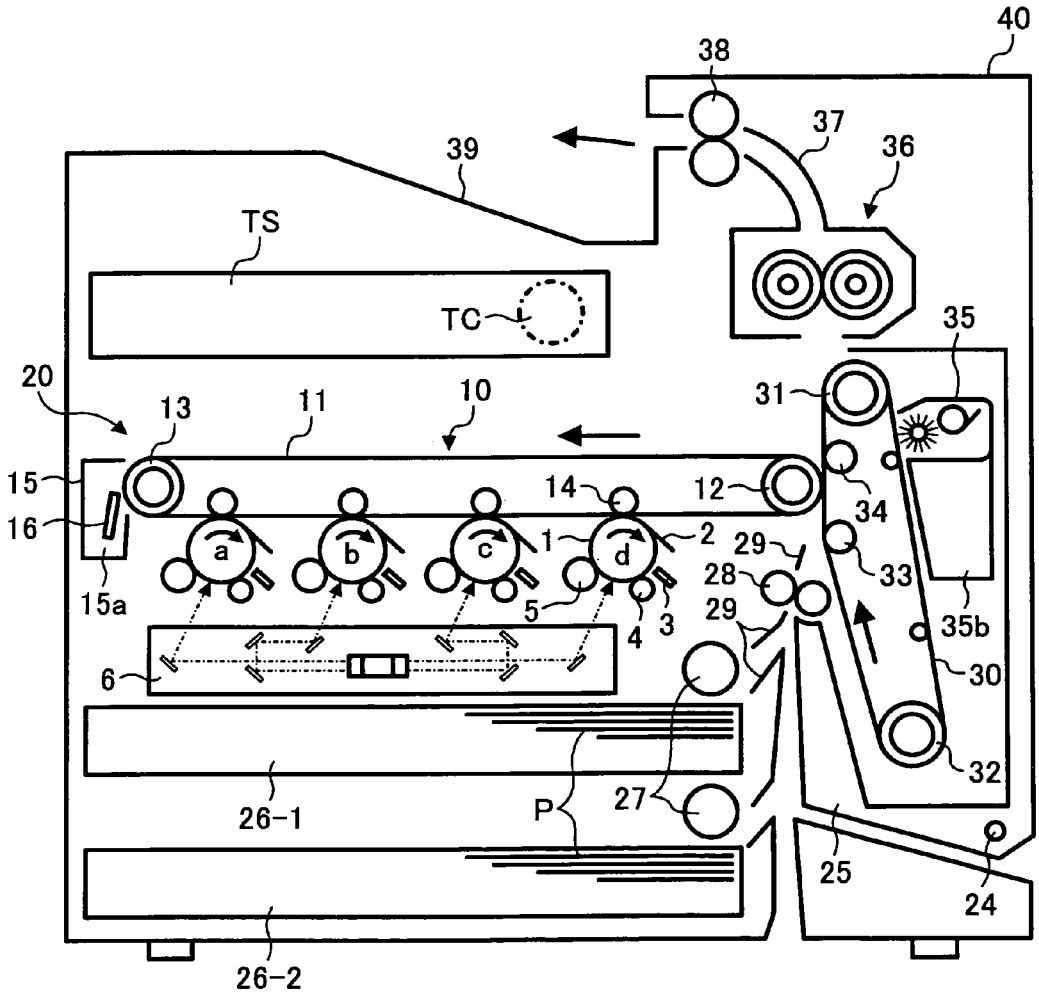
FIG. 1 is a cross-sectional diagram indicating a schematic configuration of an image forming apparatus of a first embodiment of the present invention.

The image forming apparatus of the first embodiment of the present invention is configured as a full color printer using an intermediate transfer system, and as indicated in FIG. 1, an intermediate transfer belt 11 bridged between support rollers 12 and 13 is arranged horizontally in nearly the center of the apparatus main body. Four imaging units SU are arranged in parallel along the lower running edge of this intermediate transfer belt 11. The imaging units SU have the devices necessary for electronic photographic processing, such as cleaning means 2, neutralization means 3, charging means 4, and a developing apparatus 5, arranged around a central photosensitive drum 1. The configuration of each imaging unit SU (a, b, c, d) is the same, but the color of the toner handled by the developing apparatus 5 differs with magenta, cyan, yellow and black respectively.

An exposure apparatus 6 is arranged below the imaging units SU. The exposure apparatus 6 of the present embodiment uses the well-known laser system, and forms a latent image by irradiating writing light corresponding to various color image data on to the surface of the photosensitive member. An exposure apparatus comprising an LED array and focusing means may also be adopted.

The intermediate transfer belt 11 is a belt having a resin film or rubber substrate with a thickness of 50 to 600 μm, and has a resistance value that makes toner transfer from the photosensitive member 1 possible. The intermediate transfer belt 11 rotates and runs counterclockwise in the diagram by means of the drive roller 12 connected to drive means not indicated in the diagram. A transfer roller 14, which is the primary transfer means, is arranged opposite the photosensitive member 1 on the back side of the surface of the intermediate transfer belt 11 that contacts the photosensitive member 1. These intermediate transfer belt 11, support rollers 12 and 13, and transfer roller 14 taken together as an intermediate transfer apparatus 10 (first unit) can be attached to and detached from the image forming apparatus main body.

A cleaning blade 16, which is a cleaning member, and a cleaning apparatus 15 having a recovery unit 15*a* are arranged in a position opposing the support roller 13 on the outside of the belt loop, and wipe off unnecessary toner and paper dust remaining on the surface of the intermediate transfer belt 11. This cleaning apparatus 15 (second unit) can be attached to and detached from the intermediate transfer apparatus 10 and the image forming apparatus main body. Further, the intermediate transfer apparatus 10 and the cleaning apparatus 15 may form a single intermediate transfer unit 20 that can be attached to and detached from the main unit. These attachment and detachment mechanisms and the attachment and detachment method will be explained later.

A transport belt 30 is extended vertically on the right side of the intermediate transfer belt 11 in the diagram. The transport belt 30 is wound around the support rollers 31, 32, and 33, and a drive roller 31 is driven by drive means not indicated in the diagram, and rotates clockwise in the diagram. On the back side of this transport belt 30 (inside the loop), a transfer roller 34 is arranged near the roller 12 that supports the intermediate transfer belt 11, and operates as secondary transfer means that transfers the toner image supported on the intermediate transfer belt 11 onto the recording medium. In addition, a cleaning apparatus 35 for the transport belt 30 in question is arranged on the outside of the loop of the transport belt 30. This cleaning apparatus 35 comprises recovery unit 35*b*, and removes unnecessary toner remaining on the transfer and transport belt apparatus 100 after the toner is transferred to the paper. The aforementioned secondary transfer roller 34, a support roller 33, and the support roller 12 form a pre-stipulated transfer nip in the place where the transport belt 30 touches the intermediate transfer belt 11.

The recording medium, paper P, is stored in the two stage paper feed cassette 26-1 and 26-2 mounted in the paper feed unit. The paper at the highest position is fed by feeding means comprising the paper feed roller 27, and the paper that has been fed is introduced to a plurality of guide members 29 and 25 and transported to a resist roller pair 28.

A fixing apparatus 36, in which a heat source such as a heater is housed, is provided above the transport belt 30, and paper ejection guide 37, paper ejection roller pair 38 are arranged following the fixing apparatus 36. A frame 40, which is one part of the main unit where the transport belt 30 is arranged, has a structure that can open and close by rotating around opening and closing spindle 24; and if paper P is jammed, the paper transport route can be widely opened and the jammed paper can be easily removed.

The upper surface of the image forming apparatus main body is configured as a paper discharge stacking unit 39. Four toner cartridges TC that house supplemental toner can be set in a storage unit TS provided below the paper discharge stacking unit 39 and above the intermediate transfer belt 11. The four toner colors of the toner cartridges TC are magenta, cyan, yellow and black, and are supplied to the corresponding color developing apparatuses 5 by a powder pump not indicated in the diagram.

The image formation operation of the image forming apparatus configured as above will be explained.

The image forming apparatus of the present embodiment is a printer, and signals for writing are sent from a host machine, such as a computer for example. The exposure apparatus 6 is driven based on the image signals that have been received, and light from a laser light source (not indicated in the diagram) of the exposure apparatus made to scan by a polygon mirror rotated and driven by a motor, passes along by mirrors, etc., irradiates the photosensitive drum 1 evenly charged by the charge apparatus 4, and forms on the photosensitive drum 1 a latent image corresponding to the write information (color separated color image data).

The latent image formed on the photosensitive drum 1 is developed by the developing apparatus 5, becomes a toner image, and is formed and supported on the surface of the photosensitive drum 1. This toner image is transferred by the primary transfer roller 14 to the surface of the intermediate transfer belt 11, which moves in synchronization with the photosensitive drum 1. The toner remaining on the surface of the photosensitive drum 1 after toner image transfer is cleaned by the cleaning means 2, and the photosensitive drum 1 is subsequently neutralized by neutralizing apparatus 3, and is prepared for the next imaging cycle.

The toner image transferred from the photosensitive drum 1 of the imaging unit a is carried on the surface of the intermediate transfer belt 11 and is moved in the direction of the arrow. A latent image corresponding to a particular color is written on the photosensitive drum 1 of the imaging unit b, is developed with the corresponding color toner, and becomes a toner image. This image is laminated on the toner image of the previous color that is riding on the intermediate transfer belt 11, and finally the full color image is formed by laminating the toner images of the four colors that are formed by the imaging units a, b, c, and d. Further, the transport belt 30 also moves in the direction of the arrow in synchronization with the intermediate transfer belt 11.

When the toner image on the intermediate transfer belt 11 moves up to a specified location, paper feeding begins. Specifically, the paper feed roller 27 rotates in the direction of the arrow, the paper P on the top of either paper feed cassette 26-1 or 26-2 is drawn up, and transported to the resist roller pair 28. Then, the paper is sent from the resist roller pair 28 at a timing set to make a normal image position. The secondary transfer roller 34 transfers the toner image of four colors laminated on the intermediate transfer belt 11 all at once onto the surface of one side of the paper P sent between the intermediate transfer belt 11 and the transport belt 30.

In the present embodiment, the polarity of the electrostatic latent image formed on the surface of the photosensitive drum 1 is positive, and the polarity of the toner that forms the image on the photosensitive member is negative. The toner supported on the photosensitive member 1 is transferred to the intermediate transfer belt 11 providing a positive charge on the primary transfer roller 14 greater than the charge of the latent image on the photosensitive member 1. In addition, the toner supported on the intermediate transfer belt 11 is transferred to the paper P by providing a positive charge on the secondary transfer roller 34.

With the toner image transferred to the surface as described above, the paper P is transported to the fixing means 36, the toner image on the paper P is fixed, and the paper passes through the guide 37 and is discharged to the paper discharge stacking unit 39 by the paper discharge roller pair 38.

With the paper discharge unit 39 configured as indicated in FIG. 1, it is possible to have the pages stack in order from page 1 because the pages are carried to the paper discharge unit 39 with image surface on the bottom. After the image has been transferred from the intermediate transfer belt 11 to the paper P, the unnecessary toner and paper dust are removed from the surface of the belt by the cleaning apparatus 15 that has the cleaning blade 16 on the inside, and are stored in the recovery unit 15*a*.

Here, the operation of forming an image on one side of the paper only has been described, but a configuration that forms images on both sides of the paper is also possible by using the transport belt 30 as a second intermediate transfer belt. When forming images on both sides of the paper P, a four color laminated toner image, which is the first image supported on the front side of the intermediate transfer belt 11, is transferred to the second intermediate transfer belt 30 by the secondary transfer roller 34. Subsequently, while a four color laminated toner image, which is the second image, is being formed on the intermediate transfer belt 11, the first image is carried on the second intermediate transfer belt 30 and transported to the transfer position. The timings of the intermediate transfer belt 11, the second intermediate transfer belt 30, and the resist roller pair 28 are coordinated, and the first and second images are simultaneously transferred to both surfaces of the paper.

The paper P, onto both sides of which toner images have been transferred, is sent to the fixing means 36, and the images on both sides are simultaneously fixed, the paper passes through the guide 37, and is discharged and stacked into the discharge unit 39 by the discharge roller 38. Here, a description has been give relating to image formation of a color image using toners with a plurality of colors, but the operation could also apply to monochrome images.

Next, an explanation will be given of how the characteristic parts of the present embodiment, namely, the intermediate transfer apparatus 10, the cleaning apparatus 15 and the intermediate transfer unit 20, are attached to and detached from the apparatus main body.

Figure 2:
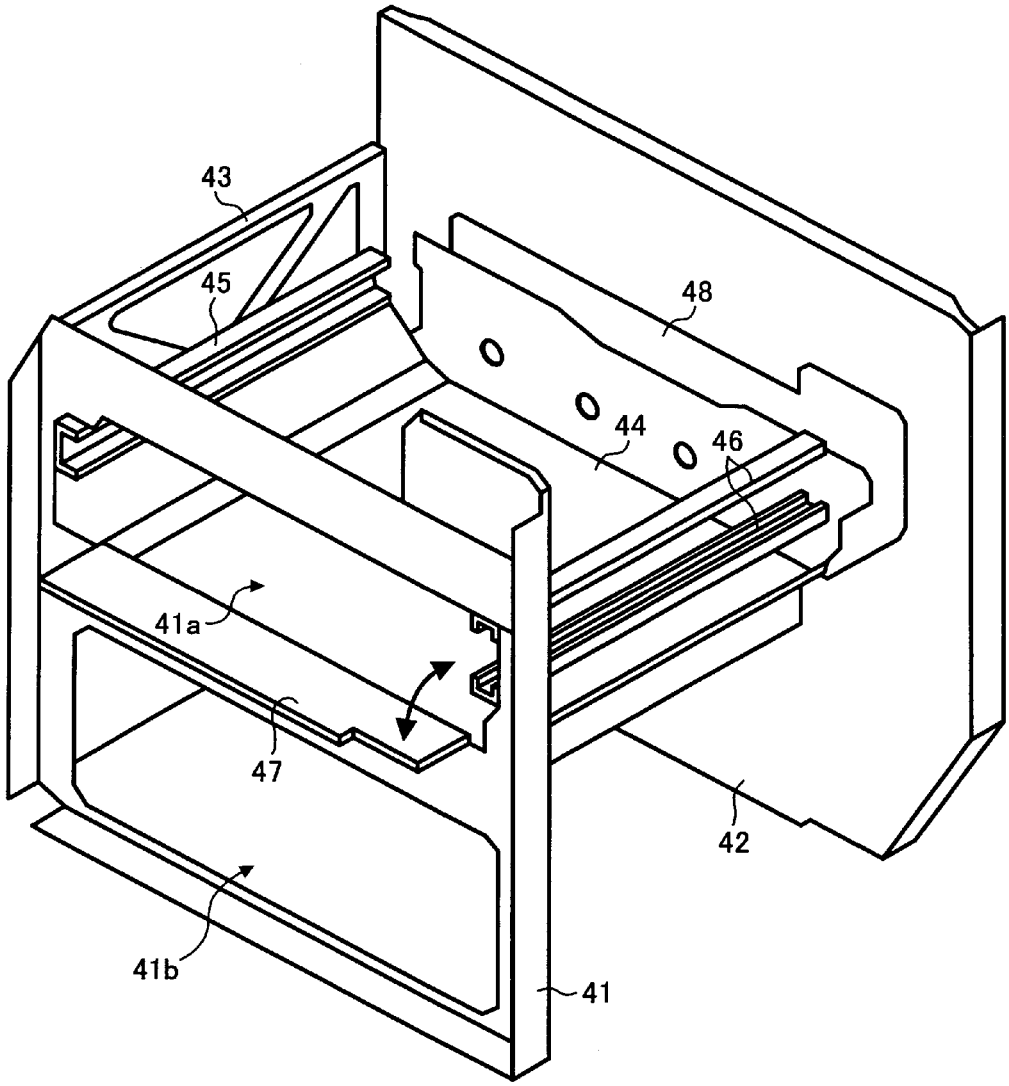
FIG. 2 is an angle perspective diagram indicating the configuration of the frame of the same image forming apparatus main body.

FIG. 2 is a perspective diagram indicating the configuration of the frame of the apparatus main body. As indicated in this diagram, the main unit frame is configured by front and back plates 41, 42, and side plate 43 and bottom plate 44, which are connected between those front and back plates. In addition, left guide rail 45 and right guide rail 46 (guide member for first unit) for supporting the insertion and extraction of the aforementioned intermediate transfer apparatus 10 are secured between the front and back plates 41 and 42. The right guide rail 46 is configured by a top and bottom pair such that the intermediate transfer belt 11 and the transport belt 30 can make contact.

Two openings 41*a, b* are provided above and below on the front plate 41. The upper opening 41*a* is an opening for attaching and detaching the intermediate transfer apparatus 10, the cleaning apparatus 15, the intermediate transfer unit 20, and the various imaging units SU to the apparatus main body. A photosensitive member plate 47 is mounted and supported rotatably in the front plate 41 in order to open and close this upper opening 41*a*. The lower opening 41*b* is an opening for inserting and extracting the paper feed cassettes 26-1 and 26-2 described above.

A drive unit 48 is mounted on the back plate 42. This drive unit 48 comprises drive mechanisms such as motors and gears for driving the drive rollers of the photosensitive drums 1 of the various imaging units SU, of the developing apparatus 5, or of the intermediate transfer belt 11.

Figure 3:
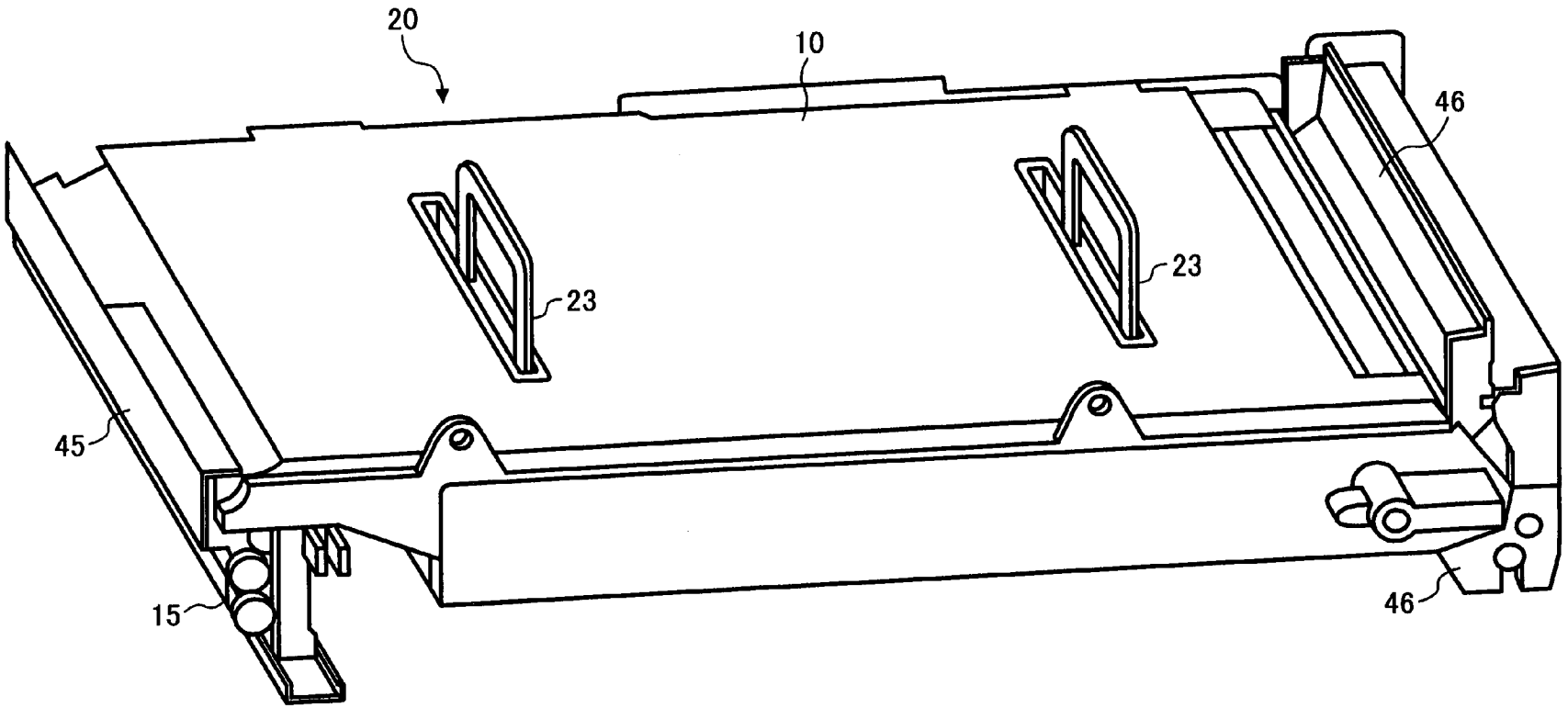
FIG. 3 is a perspective diagram indicating the configuration of the intermediate transfer unit of the same image forming apparatus.

FIG. 3 is a perspective view diagram indicating the state when the intermediate transfer unit 20 is supported in the left and right guide rails 45 and 46. In this diagram, the frame of the main unit, etc. has been omitted. The intermediate transfer unit 20 comprising the intermediate transfer apparatus 10 and the cleaning apparatus 15 is supported on the right and left guide rails 45 and 46, and can be attached to and detached from the apparatus main body as a single unit.

A pair of grips 23 and 23 is provided on the top of the intermediate transfer apparatus 10. These grips 23 and 23 can be pulled out as indicated in the diagram when pulling the intermediate transfer apparatus 10 or the intermediate transfer unit 20 from the apparatus main body. Then the grips can be folded along the top of the intermediate transfer apparatus 10 when inserting the intermediate transfer apparatus 10 or the intermediate transfer unit 20 into the apparatus main body.

Further, when attaching and detaching the intermediate transfer apparatus 10 (intermediate transfer unit 20), the intermediate transfer belt 11 is configured to separate from the photosensitive drums 1 of the various imaging units and from the transport belt 30 based on a mechanism not indicated in the diagram. In the present embodiment, every time an image formation operation is completed, the intermediate transfer belt 11 and the photosensitive drums 1 are separated at the imaging units (a to c) other than the black imaging unit. At the black imaging unit, the intermediate transfer belt 11 and the photosensitive drum 1 are configured to always make contact (even when not performing image formation), and therefore, when attaching and detaching the intermediate transfer apparatus 10 (intermediate transfer unit 20), the transfer roller 14 of the black imaging unit (d) is configured to be moved upward by the previously described mechanism when the intermediate transfer belt 11 and the photosensitive drum 1 separate.

Figure 4:
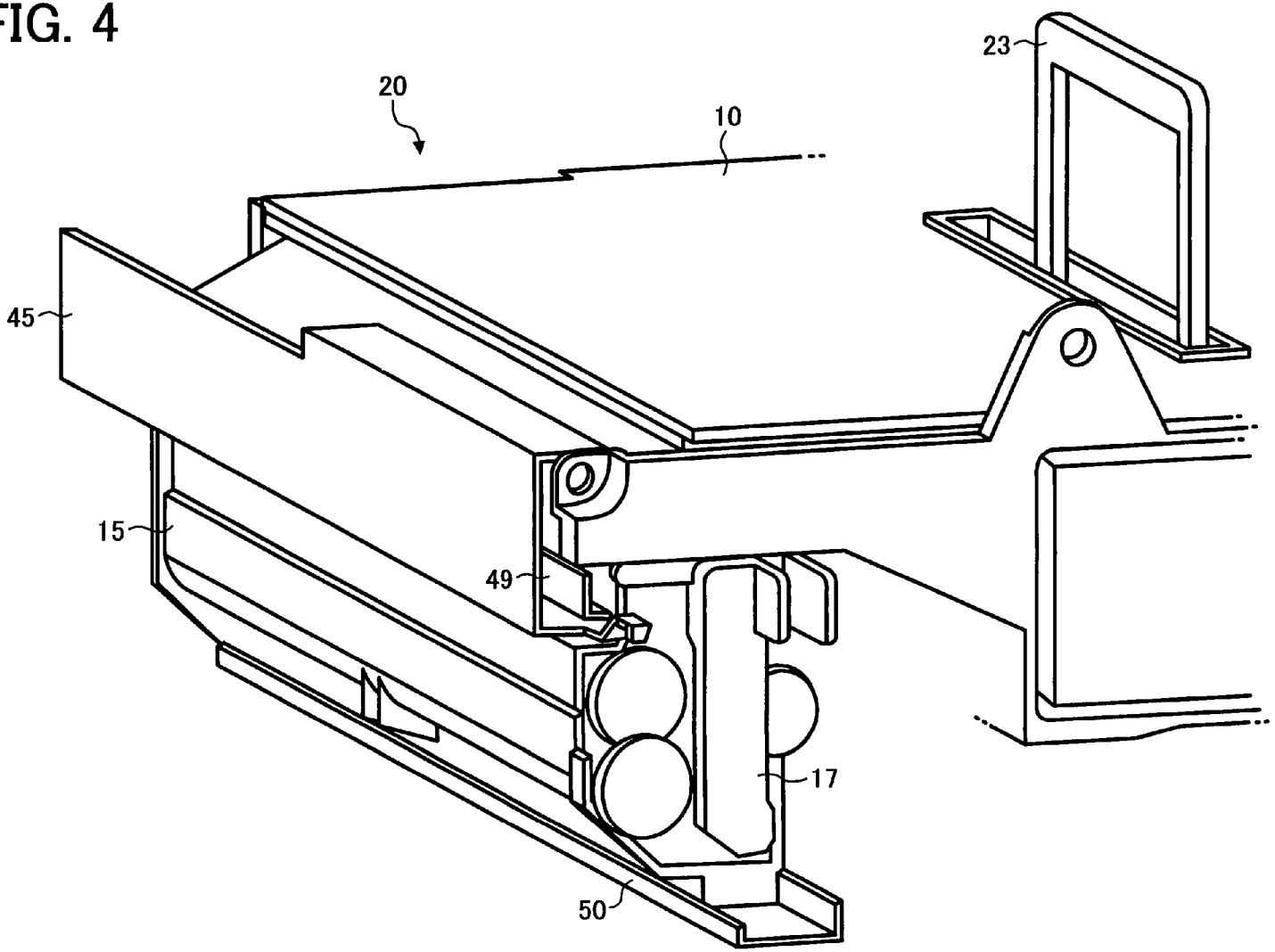
FIG. 4 is a diagram indicating the configuration of the mounting part of the cleaning apparatus of the same image forming apparatus.

FIG. 4 is an enlargement diagram of a part with the cleaning apparatus 15 mounted. The cleaning apparatus 15 can slide and is supported by upper rail 49 and lower rail 50, which are guide members for the second unit. The upper rail 49 is secured to left guide rail 45. In addition, the lower rail 50 is secured to the frame, not indicated in the diagram, of the intermediate transfer apparatus 10. Specifically, of the two rails that support the cleaning apparatus 15, one (upper rail 49) is supported on the frame of the image forming apparatus main body through the left guide rail 45, and the other (lower rail 50) is supported on the intermediate transfer apparatus 10. Further, a configuration is also possible that supports both the upper rail 49 and the lower rail 50, which support the cleaning apparatus 15, on the intermediate transfer apparatus 10 (on the frame of the intermediate transfer apparatus 10 not indicated in the diagram).

When detaching the cleaning apparatus 15, which houses the recovered toner, etc. inside, the cleaning apparatus 15 is guided by the upper rail 49 and the lower rail 50, and therefore, the cleaning apparatus 15 does not tip during removal, and no toner, etc. drops from the recovery unit 15*a* (refer to FIG. 1). As demonstrated by FIG. 1, the opening part of the recovery unit 15*a* (opening part that receives the toner and paper dust scraped off by the cleaning blade 16) is always supported facing upward when detaching the cleaning apparatus 15, and therefore, there is no spilling of toner, etc. from that opening part during removal.

Figure 5:
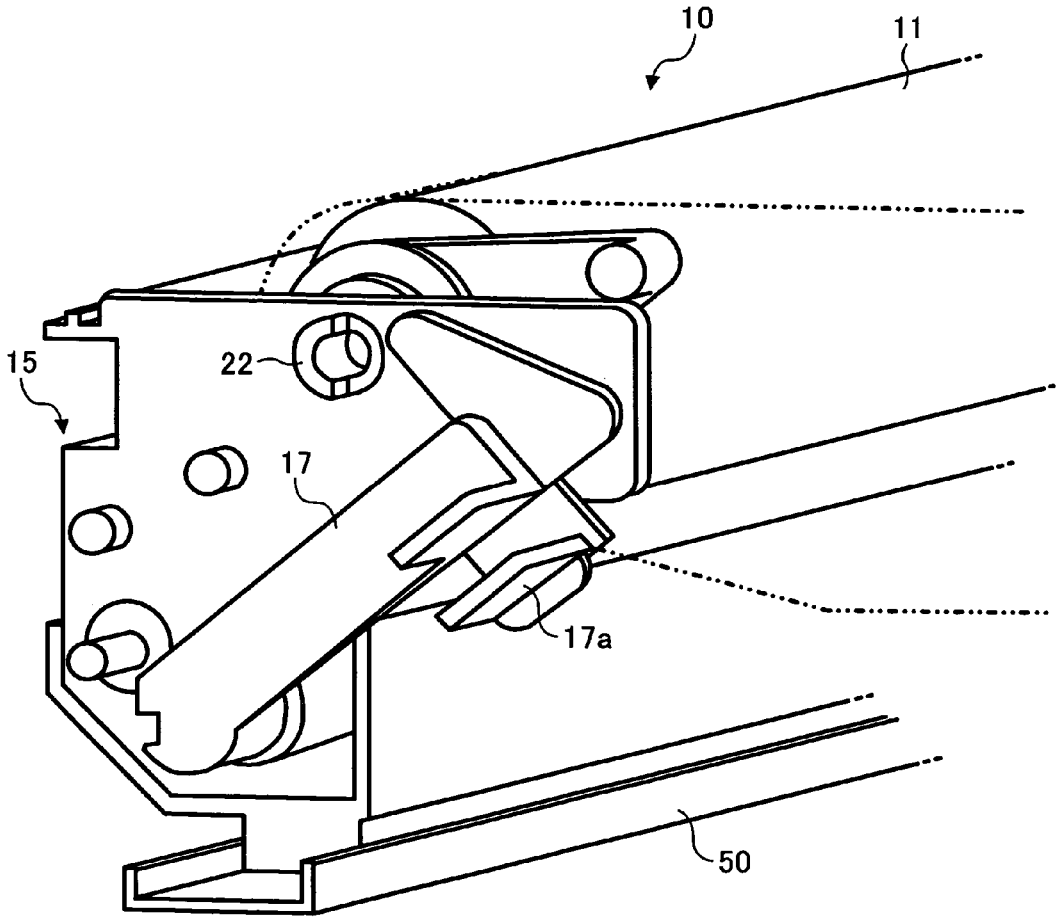
FIG. 5 is a perspective diagram indicating the cleaning apparatus of the same image forming apparatus when the lock lever has been rotated.

A lock lever 17 (lock member for second unit) is provided on the end of the front side (apparatus front side) of the cleaning apparatus 15. This lock lever 17 can rotate on the lower end part, and is in the lock position when standing up straight as indicated in FIG. 4, and is in the lock release position when rotated as indicated in FIG. 5. A mating part 17*a* is formed on the lock lever 17, and when this mating part 17*a* mates with the mating part 22 of the intermediate transfer apparatus 10, the cleaning apparatus 15 is locked and cannot be pulled out in relation to the intermediate transfer apparatus 10.

Figure 6:
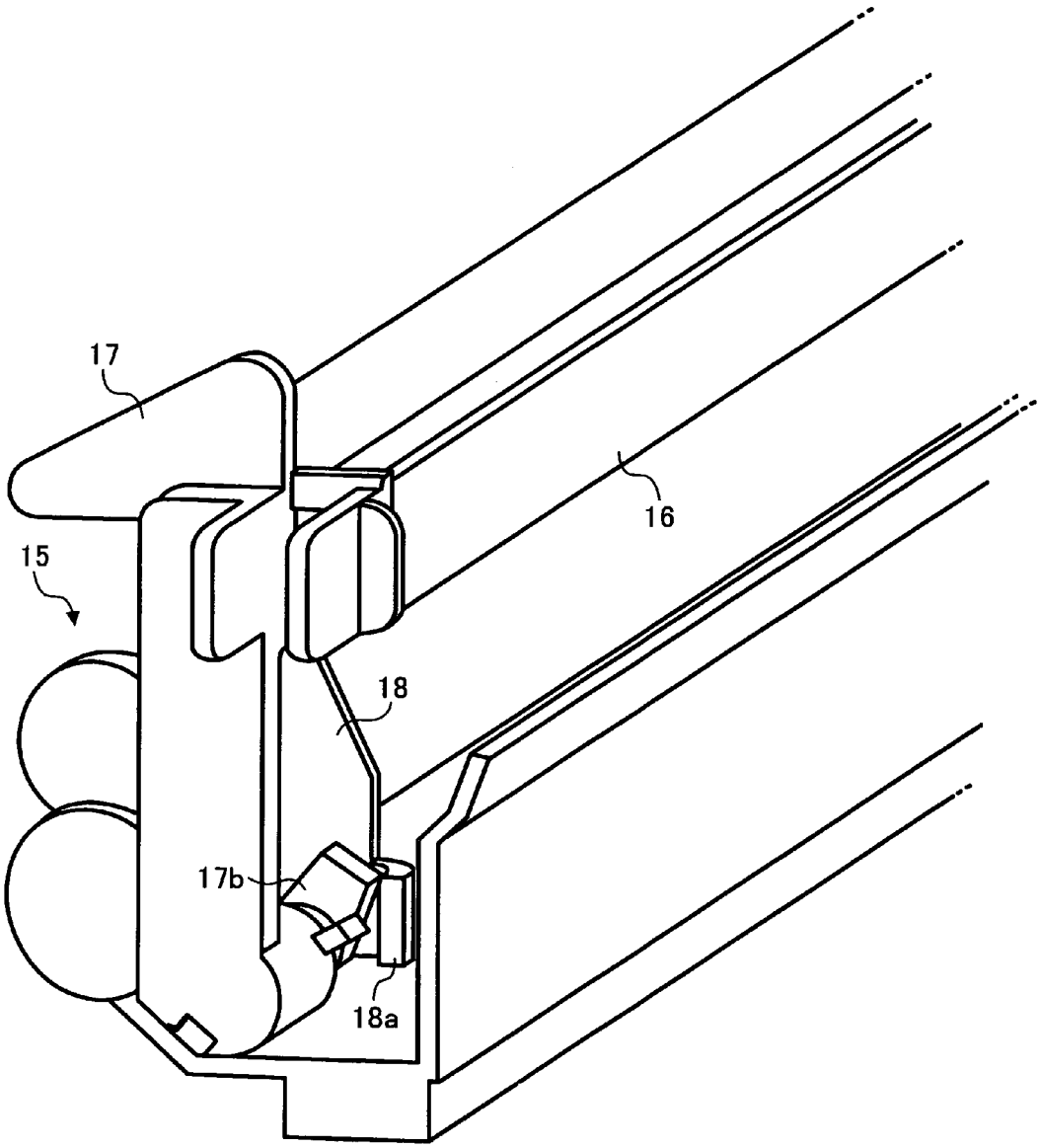
FIG. 6 is a perspective view diagram for explaining the mechanism that moves the blade of the same image forming apparatus.

As indicated in FIG. 6, a rotating pressure part 17*b* is provided on the lock lever 17, and when the lock lever 17 is rotated to the lock release position of FIG. 5, the aforementioned pressure part 17*b* makes contact with a contact part 18*a* of a link member 18, the link member 18 is rotated clockwise in FIG. 6, the upper end of that link member 18 contacts a supplementary member (not indicated in the diagram) mounted on the end of the cleaning blade 16, the cleaning blade 16 is rotated counter-clockwise in FIG. 6, and the cleaning blade 16 is separated from the intermediate transfer belt 11. Then, when the lock lever 17 is rotated to the straight up state (lock position) as indicated in FIG. 6, the blade 16 makes contact with the intermediate transfer belt 11.

Figure 7:
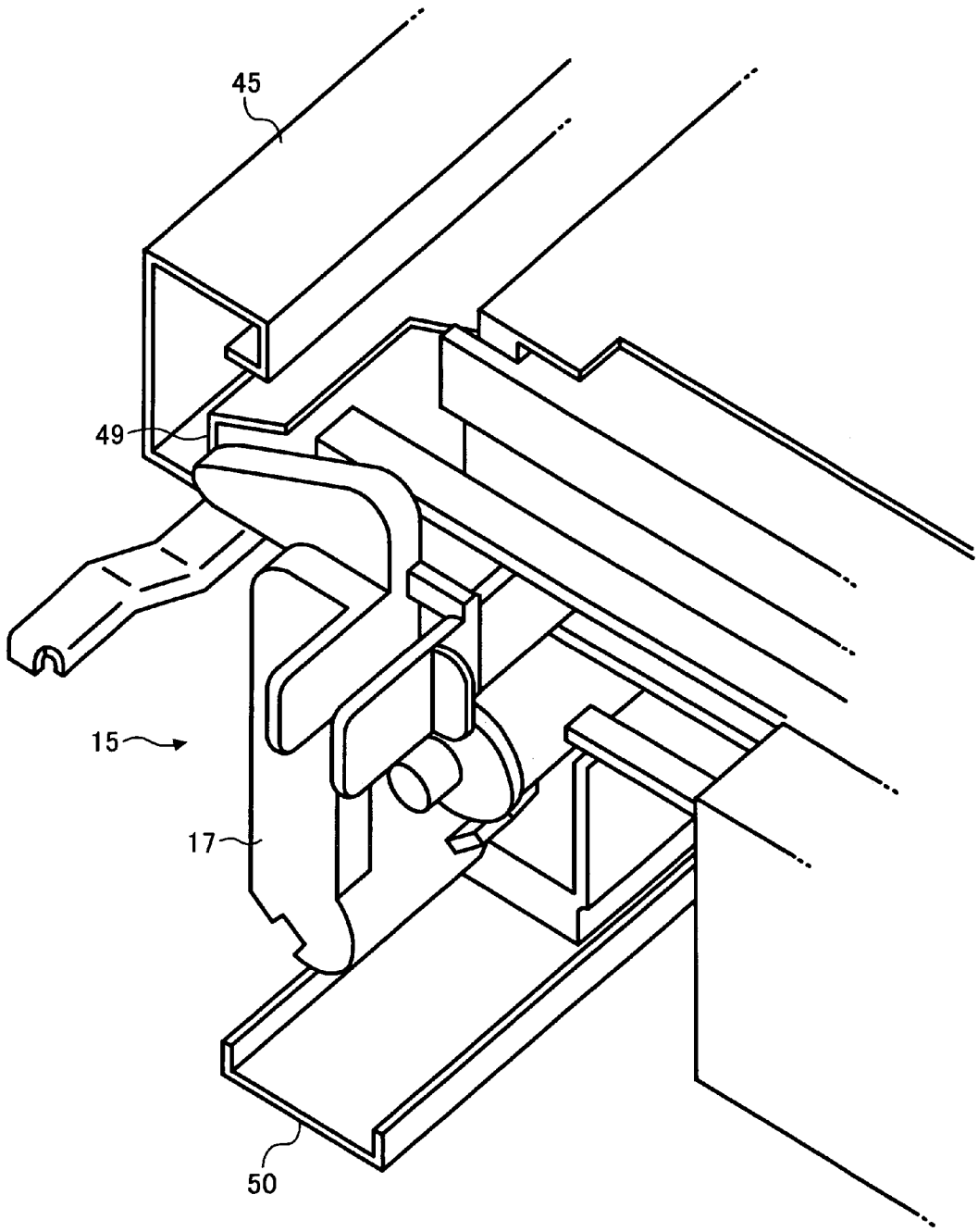
FIG. 7 is a perspective view diagram indicating from another angle the mounting part of the cleaning apparatus of the same image forming apparatus.

The state when the lock lever 17 is rotated to the lock position is indicated from a different angle in the perspective diagram of FIG. 7. The left guide rail 45 and the two rails 49 and 50 that support the cleaning apparatus 15 are indicated in this FIG. 7. The cleaning apparatus 15 can be attached to and detached from to the intermediate transfer apparatus 10 by sliding the cleaning apparatus while supported and guided by the upper and lower rails 49 and 50. Moreover, when the intermediate transfer unit 20 (intermediate transfer apparatus 10 and cleaning apparatus 15) is drawn out from the apparatus main body, the cleaning apparatus 15 is supported on the intermediate transfer apparatus 10 by only the lower rail 50, and the cleaning apparatus 15 can be attached to and detached from the intermediate transfer apparatus 10 by sliding while supported and guided on the lower rail 50.

Figure 8:
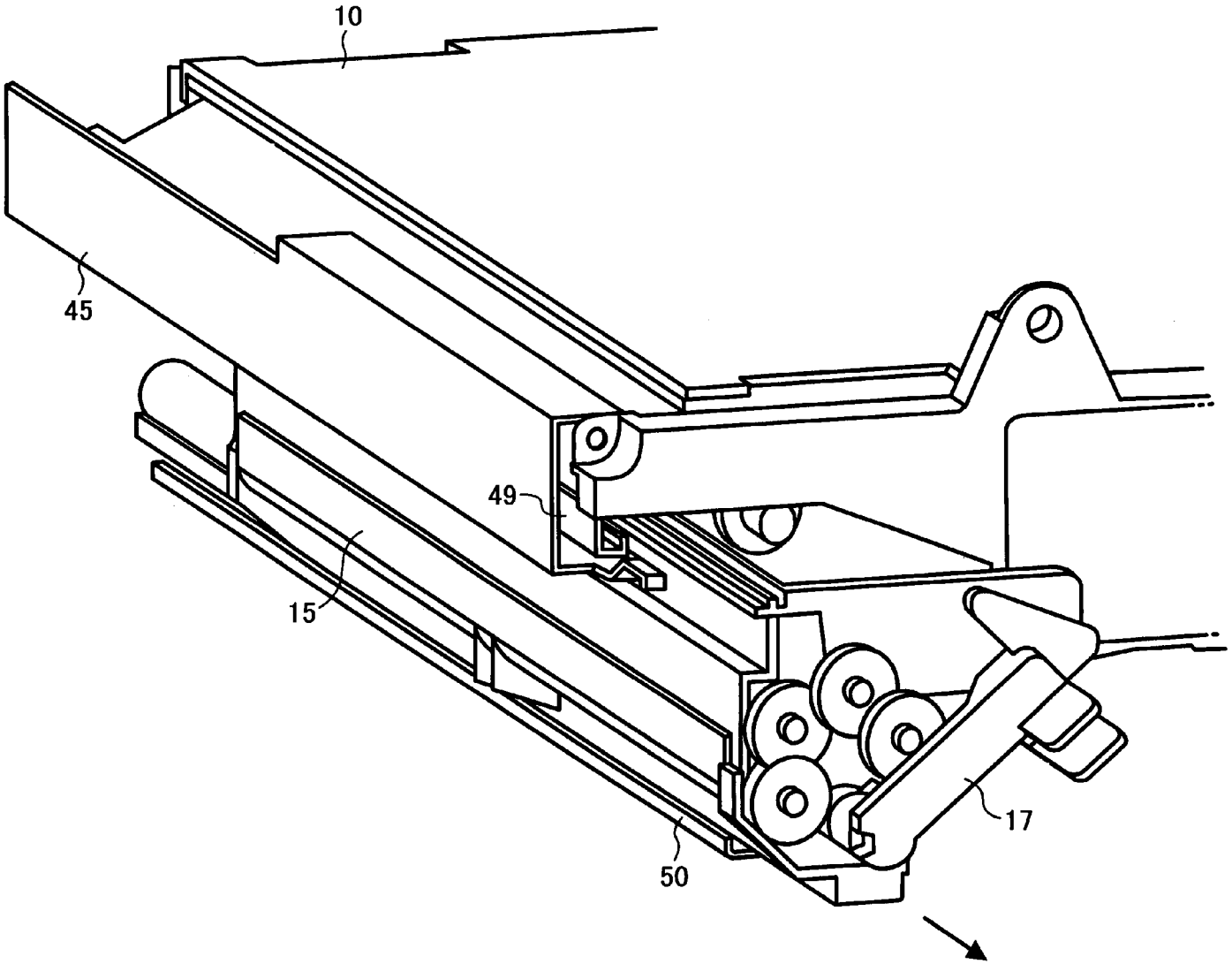
FIG. 8 is a perspective view diagram indicating the removal of the cleaning apparatus of the same image forming apparatus from the intermediate transfer apparatus.

FIG. 8 is a perspective diagram indicating the condition when the lock lever 17 is released and the cleaning apparatus 15 is removed from the intermediate transfer apparatus 10. The two rails 49 and 50 that support the cleaning apparatus 15 are provided in parallel to the left and right guide rails 45 and 46 that support the intermediate transfer unit 20 (intermediate transfer apparatus 10). For this reason, the direction of attaching and detaching the cleaning apparatus 15 is the same as the direction for attaching and detaching the intermediate transfer unit 20 (intermediate transfer apparatus 10). Moreover, these left and right guide rails 45 and 46 and the upper and lower rails 49 and 50 are all provided in parallel to the support rollers 12 and 13 of the intermediate transfer belt 11. Consequently, the directions of attaching and detaching the intermediate transfer unit 20 and the cleaning apparatus 15 are parallel with the rotational axis of the intermediate transfer belt 11. The cleaning apparatus 15 is guided and moves in parallel with the rotational axis of the intermediate transfer belt 11, and therefore, there is no tipping over when attaching and detaching, and the toner and paper dust, etc. recovered in the recovery unit 15*a* is prevented from falling out. In addition, useless contact between the cleaning blade 16 and the intermediate transfer belt 11 can be easily prevented. Consequently, the cleaning apparatus 15 is easily detached from the apparatus main body or from the intermediate transfer unit 20.

Figures 9A, 9B, 9C, 9D:
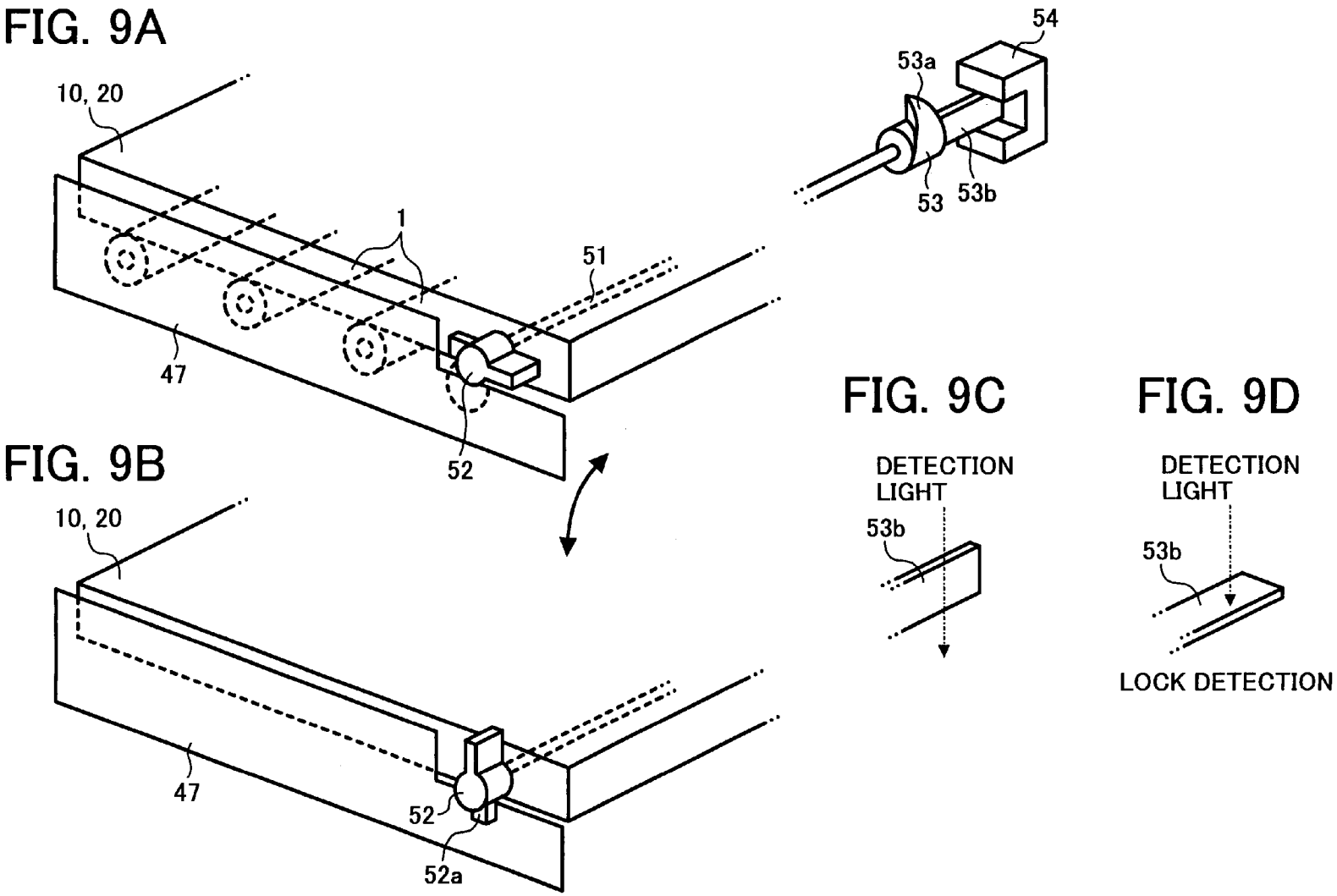
FIGS. 9A to 9D are pattern diagrams indicating the lock mechanism that restricts removal of the intermediate transfer apparatus of the same image forming apparatus.

As described above, the intermediate transfer apparatus 10 (intermediate transfer unit 20) is supported by the left and right guide rails 45 and 46, and is configured to be able to attach to and detach from the apparatus main body. A lock mechanism (lock member for first unit) that restricts the removal of that intermediate transfer apparatus 10 (intermediate transfer unit 20) is provided as indicated in FIG. 9. Specifically, a lock lever 52 is secured to the front end of a spindle 51 that is supported rotatably through the intermediate transfer apparatus 10. A lock mechanism 53 is secured to the rear end of the spindle 51. A triangular protruding part 53*a* is formed on the lock member 53. As indicated in FIG. 9A, the lock release state is when the arm of the lock lever 52 is in the horizontal position, and the protruding part 53*a* of the lock member 53 at this time is positioned nearly straight up. As indicated in FIG. 9B, when rotating the lock lever 52 90 degrees counter-clockwise, the protruding part 53*a* of the lock member 53 faces horizontally (faces left).

Figure 10A:
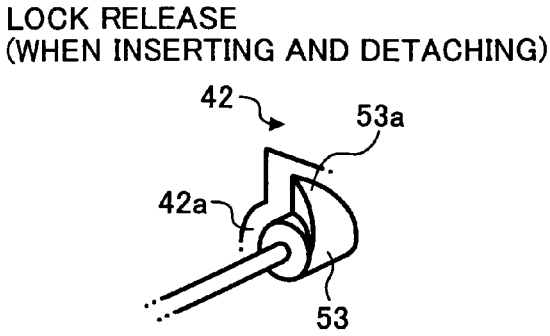
FIGS. 10A and 10B are pattern diagrams to explain the lock and lock release operations of the lock mechanism.
Figure 10B:
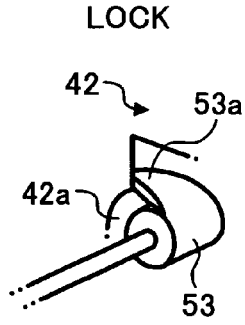

Meanwhile, an insertion part 42*a* that the lock member 53 enters is provided on the rear plate 42 of the main unit frame as indicated in FIGS. 10A and 10B. When setting the intermediate transfer apparatus 10 (intermediate transfer unit 20) to the back of the apparatus main body, the lock member 53 enters from the insertion part 42*a* to the rear side of the rear plate 42. When the lock lever 52 is in the state shown in FIG. 9A, the relationship between the lock member 53 and the rear plate 42 of the frame is not one of the protruding part 53*a* engaging the rear plate 42 as indicated in FIG. 10A, and the intermediate transfer apparatus 10 (intermediate transfer unit 20) can be attached to and detached from the apparatus main body.

With the intermediate transfer apparatus 10 (intermediate transfer unit 20) inserted to the back of the apparatus main body and the lock lever 52 rotated as indicated in FIG. 9B, the lock member 53 is also rotated, the protruding part 53*a* has entered to the back of the rear plate 42 as indicated in FIG. 10B, and in this state, even when trying to remove the intermediate transfer apparatus 10 (intermediate transfer unit 20), the intermediate transfer apparatus 10 (intermediate transfer unit 20) cannot be pulled out and is locked by the protruding part 53*a* catching on the rear plate 42.

In addition, in the lock release state of FIG. 9A, the protruding arm 52*a* of the lock lever 52 does not engage the photosensitive member plate 47, and the photosensitive member plate 47 can be opened and closed. When the photosensitive member plate 47 is opened as indicated in FIG. 2, the intermediate transfer unit 20 supported by the left and right guide rails 45 and 46, specifically, the intermediate transfer apparatus 10 and the cleaning apparatus 15, can be integrally attached to and detached from the apparatus main body. In addition, by releasing the lock lever 17 of the cleaning apparatus (by rotating to the lock release position), only the cleaning apparatus 15 can be attached and detached. FIG. 8 indicates the condition with the intermediate transfer apparatus 10 directly supported by guide rails 45 and 46 (directly mounted in the apparatus main body), and only the cleaning apparatus 15 is being removed from the intermediate transfer apparatus 10 (being drawn out to the front of the apparatus). Moreover, with the cleaning apparatus 15 removed, the intermediate transfer apparatus 10 can be independently attached to and detached from the apparatus main body. Further, the various imaging units SU can also be detached by releasing the photosensitive member plate 47.

Then, when locked as indicated in FIG. 9B with the photosensitive member plate 47 closed and the arm of the lock lever 52 rotated vertically, the protruding arm 52*a* of the lock lever 52 restrains the photosensitive member plate 47, and the photosensitive member plate 47 is locked and cannot open. Consequently, at this time the intermediate transfer unit 20 is also locked, and cannot be pulled out. Neither can the cleaning apparatus 15 be pulled out. Further, the imaging units SU cannot be detached. The lock lever 52 is a member that can rotate the lock member 53 through the spindle 51, and is also a plate retention member to retain and release retention of the plate 47.

A rear protruding part 53*b* of the lock member 53 and a sensor 54 (first unit detection means) are provided to be able to detect that the intermediate transfer apparatus 10 (intermediate transfer unit 20) is inserted to the back of the apparatus main body and locked. A photo interrupter having a light emitting part and a light receiving part may, for example, be used as the sensor 54. In the present embodiment, the rear protruding part 53*b* is formed in a flat shape, and when the rear protruding part 53*b* has approached into the detection part of the sensor 54 and is in the lock release state of FIG. 9A, the detection light is not blocked as indicated in FIG. 9C; and when the lock lever 52 is rotated and locked as indicated in FIG. 9B, the rear detection part 53*b* blocks the detection light as indicated in FIG. 9D, and the locking of the intermediate transfer apparatus 10 (intermediate transfer unit 20) is detected. The fact that the intermediate transfer apparatus 10 (intermediate transfer unit 20) has been set into the apparatus main body is thereby detected. If the sensor 54 does not detect that the intermediate transfer apparatus 10 (intermediate transfer unit 20) has been set up (locked), the apparatus is controlled such that at least the image forming operation will not be conducted. Further, in addition to the configuration explained here, it is also possible to adopt other optional detection means such as a micro-switch, etc.

Figure 11:
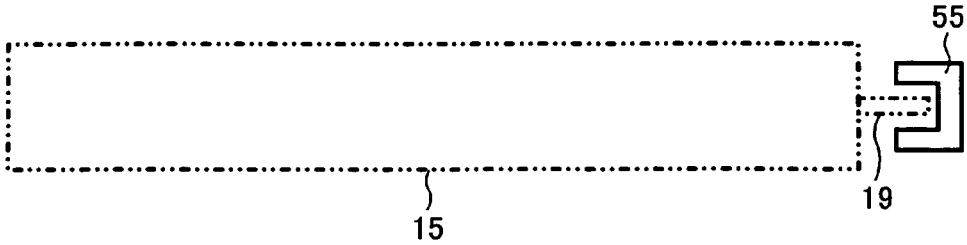
FIG. 11 is a pattern diagram indicating the configuration to detect the set up status of the cleaning apparatus of the same image forming apparatus.

Moreover, as indicated in FIG. 11, a detection part 19 is provided on the back end part of the cleaning apparatus 15, and a sensor (cleaning apparatus detection sensor) 55 to detect this detection part 19 is provided on the back of the apparatus. The cleaning apparatus 15 set up status is detected by this cleaning apparatus detection sensor 55 (second unit detection means). Specifically, even if the intermediate transfer apparatus 10 is mounted in the apparatus main body, and only the cleaning apparatus 15 has been attached or detached, the attachment or detachment of the cleaning apparatus 15 (set up status in relation to the image forming apparatus) can be detected. In addition, even if the cleaning apparatus 15 has been detached from the apparatus main body together with the intermediate transfer apparatus 10 (the intermediate transfer unit 20 has been detached from the apparatus main body), the set up status of the cleaning apparatus 15 in relation to the image forming apparatus can be detected. In the present embodiment, the cleaning apparatus detection sensor 55 detects the set up of the cleaning apparatus 15 by detecting the fact that the cleaning apparatus 15 has been inserted to the back of the apparatus main body, but lock means may be provided in the same way as for the intermediate transfer apparatus 10 (intermediate transfer unit 20), and the set up may be detected by connecting to the rotation of the lock lever 17 and detecting the lock status of the cleaning apparatus 15.

In the present embodiment, by comprising the sensor 54 that detects the attachment and detachment of the intermediate transfer apparatus 10 and the cleaning apparatus detection sensor 55, not only can the attachment and detachment status of the intermediate transfer apparatus 10 (intermediate transfer unit 20) be detected, but the attachment and detachment of the cleaning apparatus 15 alone when the intermediate transfer apparatus 10 is mounted in the apparatus main body can also be detected.

Further, although not indicated in the diagram, a front cover is provided on the exterior cover plate of the image forming apparatus, and when that front cover is opened, the front part of the frame of the apparatus appears, and the manipulation of the lock lever 52 and the opening of the photosensitive member plate 47 become possible. In addition, a custom door, etc. may be provided on the exterior cover plate at the part corresponding to the lock lever 52 and the photosensitive member plate 47.

Figure 12A:
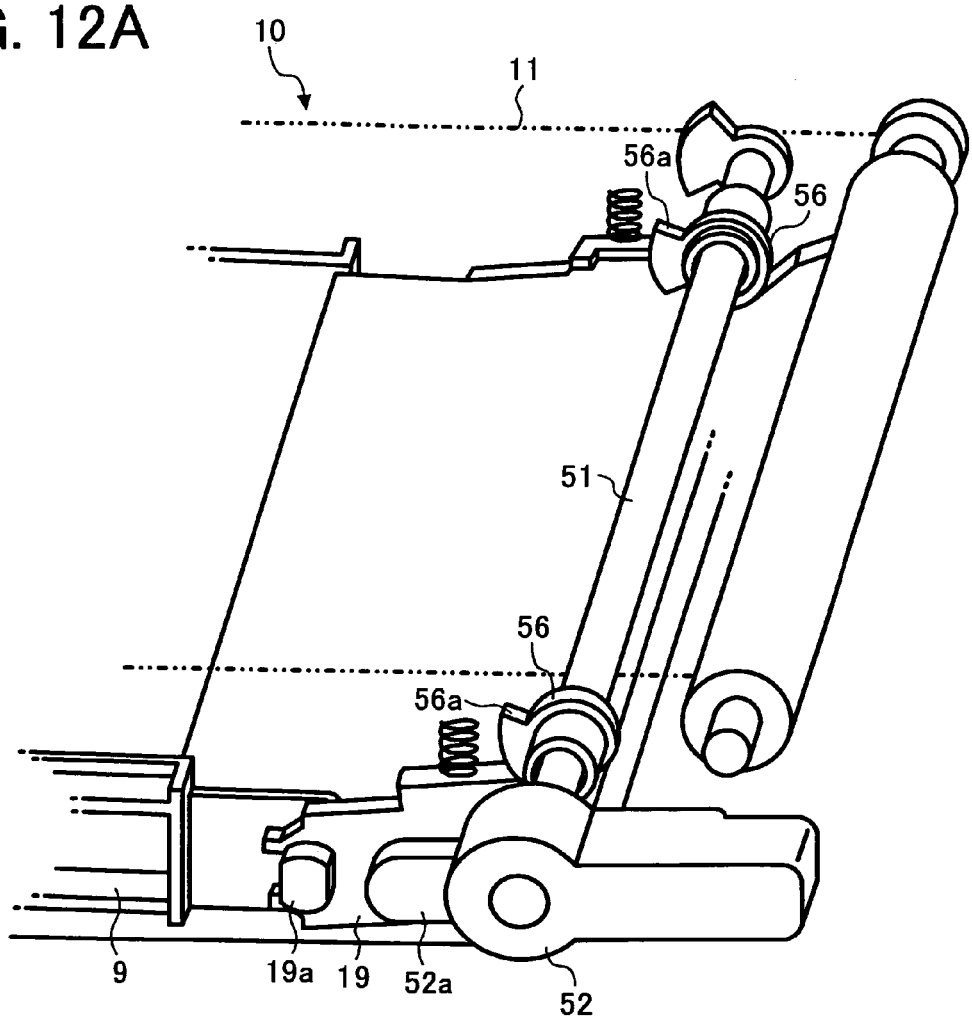
FIGS. 12A and 12B are perspective view diagrams indicating the configuration of the contact and separation mechanism of the primary transfer roller for black.
Figure 12B:
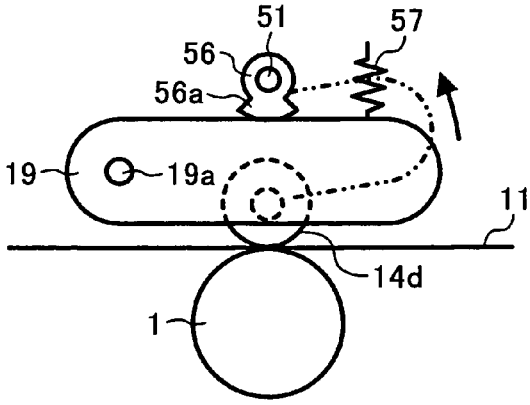

FIGS. 12A and 12B indicate the contact release mechanism of the first transfer roller for black based on the lock lever 52. As indicated in these diagrams, the first transfer roller 14-*d* for black is axially supported by a retention member 19. This retention member 19 is mounted to the frame 9 of the intermediate transfer apparatus 10 so as to freely swing on the spindle 19*a*. In addition, the tension spring 57 is latched on the retention member 19, and is energized by rotating the retention member 19 counterclockwise in the diagram (direction in which the first transfer roller 14-*d* separates from the photosensitive drum 1 of the imaging unit SU). The spindle 51 of the lock lever 52 is positioned above the retention member 19, and cam members 56, 56 are secured to this spindle 51. Convex parts 56*a* of the cam members 56, 56 are provided to engage with the retention member 19 when the lock lever 52 is rotated.

As indicated in FIG. 12A, when the lock lever 52 is in the lock release position (refer to FIGS. 9A to 9D), the convex parts 56*a* of the cam members 56, 56 do not pressurize the retention member 19, the retention member 19 is tensioned upward by the tension spring 57, the first transfer roller 14-*d* for black enters a state of being separated from the photosensitive drum 1 of the black imaging unit SU-d, and the pressure contact of the intermediate transfer belt 11 on the photosensitive drum 1 is released.

When the lock lever 52 is rotated to the lock position indicated in FIG. 9B, the cam members 56, 56 rotate 90 degrees, the convex part 56*a* presses down on the retention member 19 as indicated in FIG. 12B, and the first transfer roller 14-*d* moves downward. The photosensitive drum 1 of the black imaging unit SU-d thereby makes pressure contact with the intermediate transfer belt 11. By locking in this way so that the intermediate transfer apparatus 10 (intermediate transfer belt member 20) cannot be pulled out, the first transfer roller 14-*d* drops down, and the intermediate transfer belt 11 makes pressure contact with the photosensitive drum 1. Further, if the first transfer roller 14-*d* of the black imaging unit SU-d is also configured to separate (the photosensitive drum 1 and the intermediate transfer belt 11 separate) every time an image forming operation is completed, then the contact separation mechanism explained here is not necessary.

As described above, in this first embodiment, the intermediate transfer apparatus 10 and the cleaning apparatus 15 can be attached to and detached from the apparatus main body as the single unit of the intermediate transfer unit 20, and it is also possible to attach and detach only the cleaning apparatus 15 from the apparatus main body while the intermediate transfer apparatus 10 remains mounted on the apparatus main body. Consequently, a plurality of attachable and detachable units can be easily attached to and detached from the main unit of the apparatus, and the maintenance is simplified. When replacing the cleaning member (cleaning blade 16 in the present embodiment) that generally has a shorter operational life than that of the intermediate transfer belt, it is not necessary to remove the entire intermediate transfer unit 20 or the intermediate transfer apparatus 10, and the operation is easy. Naturally, even if removing the cleaning apparatus 15 from the intermediate transfer apparatus 10 after the intermediate transfer unit 20 has been removed from the apparatus main body, the cleaning apparatus 15 supported on the support rail 50 is easily removed by sliding.

Normally, the cleaning apparatus (cleaning apparatus 15) of the belt member is smaller and weights less than the apparatus (intermediate transfer apparatus 10) that supports the belt member that is the object to be cleaned, and in the present embodiment, when attaching and detaching the smaller of the two units (cleaning apparatus 15) that can be attached to and detached from the image forming apparatus main body, it is not necessary to remove the bigger, heavier unit (intermediate transfer apparatus 10), and the operation is easy.

In addition, in the present embodiment, it is possible to remove the intermediate transfer apparatus 10 after the cleaning apparatus 15 has been removed, and to mount the cleaning apparatus 15 after the intermediate transfer apparatus 10 has been mounted in the apparatus main body. For this reason, even people who are not strong enough when attaching and detaching the single unit of the intermediate transfer unit 20 can conduct the operation.

Then, attachment and detachment is easy because the attachment and detachment direction of the intermediate transfer apparatus 10 (intermediate transfer unit 20) is the same as that of the cleaning apparatus 15. For example, if the attachment and detachment direction of the intermediate transfer apparatus 10 (intermediate transfer unit 20) and the cleaning apparatus 15 are set up in the front to back direction of the image forming apparatus as in the present embodiment, attachment and detachment of the intermediate transfer apparatus 10 (intermediate transfer unit 20) and the cleaning apparatus 15 can be easily conducted from the front of the apparatus, and this is advantageous in terms of the installation location of the apparatus.

Moreover, making the attachment and detachment direction of the intermediate transfer apparatus 10 (intermediate transfer unit 20) and the cleaning apparatus 15 parallel to the rotational axis of the intermediate transfer belt 11 simplifies the configuration, for example, of the installation direction of the guide rails that support and make detachable the intermediate transfer apparatus 10 (intermediate transfer unit 20) and the cleaning apparatus 15.

In addition, providing detection means (sensor 54) that detect that the intermediate transfer apparatus 10 (intermediate transfer unit 20) is set up in the apparatus main body can prohibit operation of the apparatus when the intermediate transfer apparatus 10 (intermediate transfer unit 20) has not been set up, and can prevent damage to the apparatus and risk during maintenance.

In addition, it is also possible to detect the attachment or detachment of just the cleaning apparatus 15 by providing detection means (sensor 55) to detect that the cleaning apparatus 15 has been installed in the apparatus main body. Further, inability to clean the intermediate transfer belt 11 and generation of abnormal images, etc. can be prevented by prohibiting operation of the apparatus when installation of the cleaning apparatus 15 has not been detected.

Unintended dropping of the cleaning apparatus 15 can be avoided, and reliable mounting can be achieved because the attachment and detachment of the cleaning apparatus 15 has lock and lock release means (lock lever 17). Moreover, because the cleaning member (cleaning blade 16) by linkage to the lever lock and lock release can be joined to or separated from the belt member (intermediate transfer belt 11) the trouble of moving the cleaning member when attaching and detaching the cleaning apparatus 15 can be omitted, and reliable contact of the cleaning member and the belt member can be obtained.

Next, a second embodiment of the present invention will be explained.

This second embodiment is an image forming apparatus having a system that retains and transports the recording medium (paper) on the surface of a transport belt, and directly transfers the image from an image support member (photosensitive member) on to the paper that is transported, and a unit comprising the aforementioned transport belt (belt transport apparatus) can be attached to and detached from the apparatus main body.

Figure 13:
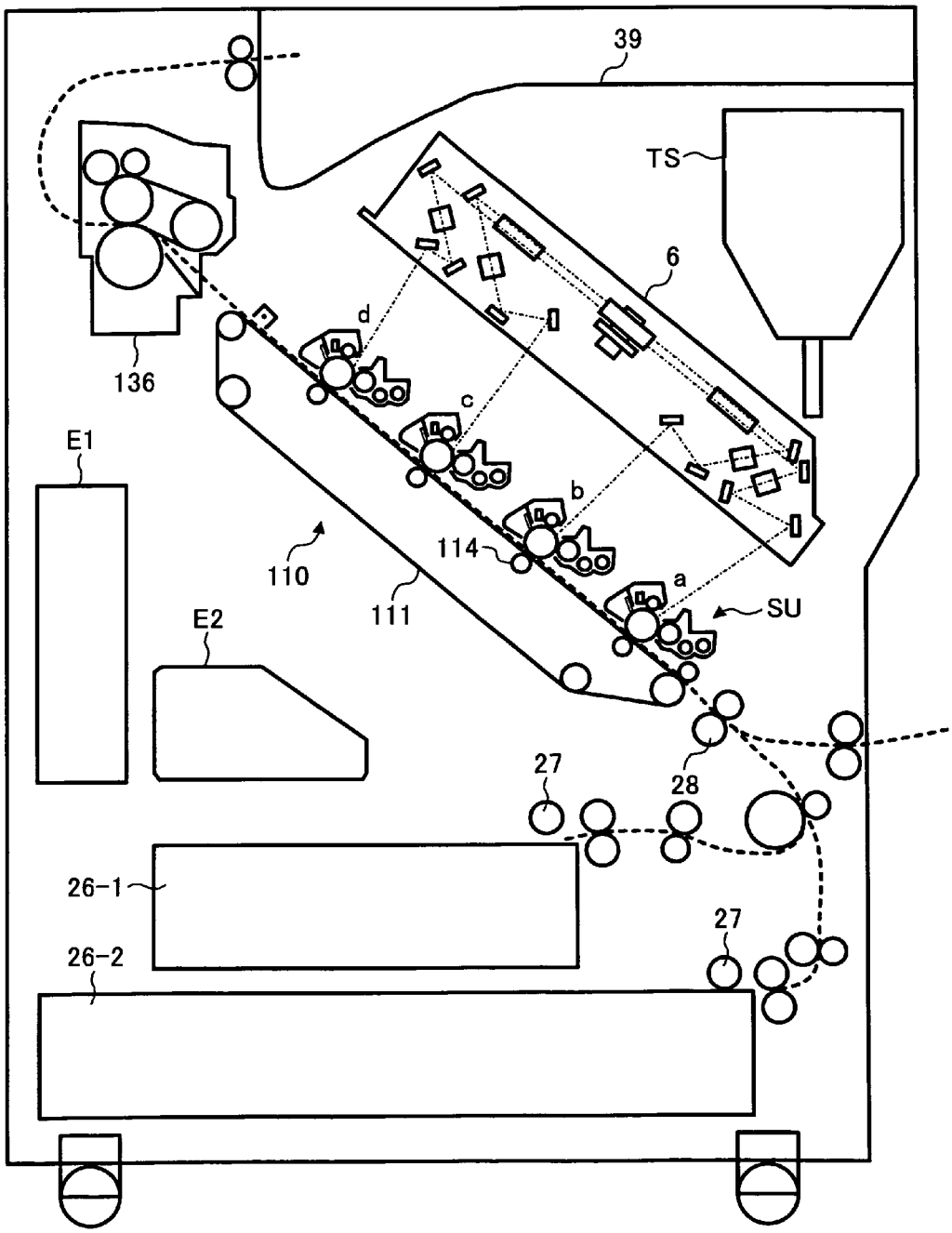
FIG. 13 is a cross-sectional diagram indicating the schematic configuration of an image forming apparatus of a second embodiment of the present invention.

FIG. 13 is a cross-sectional diagram indicating the schematic configuration of the image forming apparatus of the second embodiment. In the full color printer of the present embodiment indicated in this diagram, a transport belt apparatus 110 (first unit) is arranged at a slant in nearly the center of the apparatus main body. Arranged in order from the bottom along the upper running edge of this transport belt apparatus 110 are the four imaging units SU (a to d) for magenta (M), cyan (C), yellow (Y) and black (Bk). The configuration of the imaging units SU is the same as that of the imaging units SU of the previously described first embodiment.

The exposure apparatus 6 is arranged above the imaging units SU. The exposure apparatus 6 in the present embodiment is the well-known laser system, and latent images are formed by irradiating the surfaces of photosensitive members with writing light corresponding to the various color image data. An exposure apparatus comprising an LED array and focusing means may also be adopted. A storage unit TS that houses various bottles of color toner is provided on the right side of the exposure apparatus 6 in the diagram, and toner is supplied to the developing apparatuses 5 of the corresponding colors from the various bottles of color toner by a powder pump not indicated in the diagram. In addition, electric components E1 and E2 are arranged in the space between the transport belt apparatus 110 and the paper feed cassette 26-1.

Figure 14:
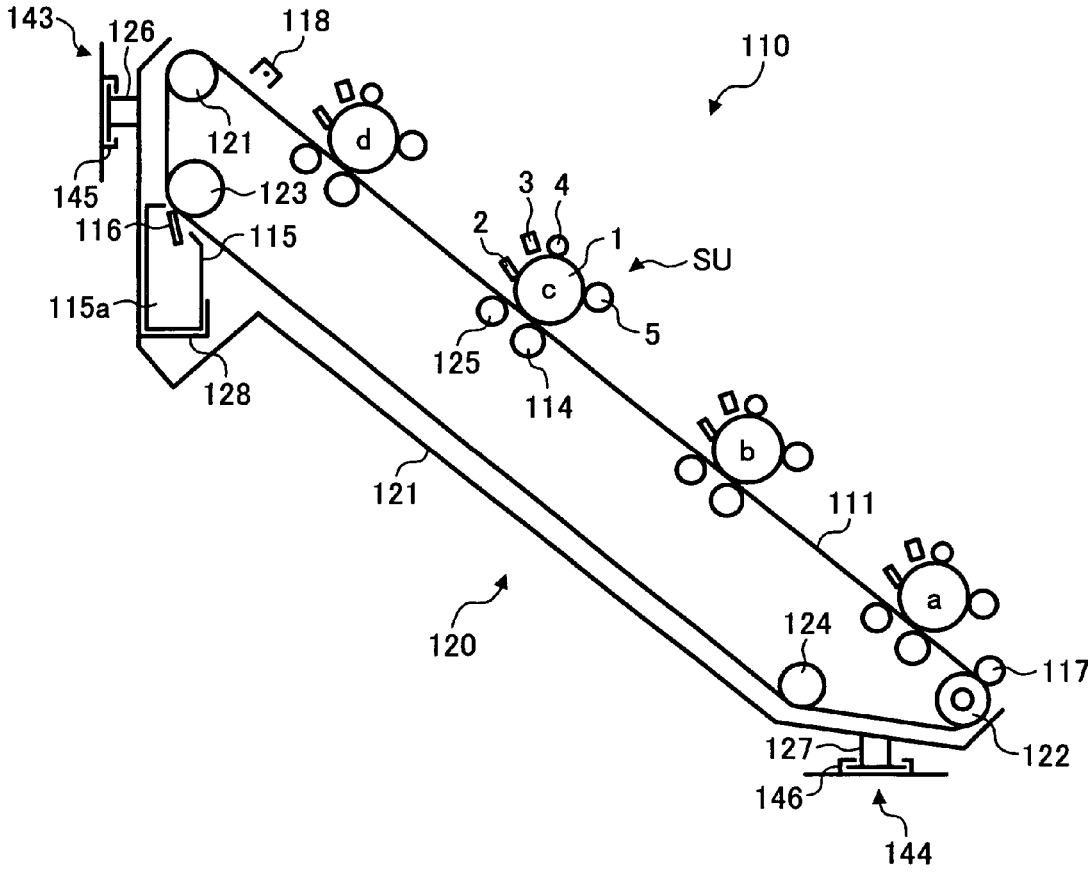
FIG. 14 is a cross-sectional diagram indicating the configuration of the belt transport unit and guide rail thereof of the same image forming apparatus.

As indicated in more detail in FIG. 14, in the transport belt apparatus 110 (first unit), a endless loop transport belt 111 is wound around and bridged between a drive roller 121, a follower roller 122, and two support rollers 123 and 124. Four supplementary rollers 125 are provided along the upper running edge of the transport belt 111. In addition, transfer rollers 114 are provided in positions respectively opposing the photosensitive drums 1 of the various color imaging units SU. Then, a paper adsorption roller 117 is provided above the follower roller 122 and presses the transport belt 111 in between. Paper is sent out on the transport belt 111 from between the follower roller 122 and the adsorption roller 117, and is transported and adsorbed on the transport belt 111 by static electricity based on bias voltage applied to the adsorption roller 117. A separation charger 118 for separating the paper from the transport belt 111 is arranged at a position in front of the drive roller 121. In addition, a belt cleaning apparatus 115 (second unit) is provided opposite the support roller 123 in order to make the cleaning blade 116 have pressure contact with the belt 111.

The print operation of the present embodiment will be briefly explained.

The surface of the photosensitive drum 1 of the imaging unit SU-a for magenta is uniformly charged to a specified electric potential by the charge means 4. By driving an LD (laser diode) not indicated in the diagram based on image data sent by a host machine such as a computer, laser light of the exposure apparatus 6 is irradiated on a polygon mirror; the reflected light is introduced onto the photosensitive drum 1 through a cylinder lens, etc.; and a latent image to be developed by magenta toner is formed on the photosensitive drum 1. Toner from the developing apparatus 5 is applied on this latent image, and becomes a magenta toner visible image.

Meanwhile, paper designated as the transfer material is supplied from the paper feed cassette 26-1 or 26-2, and the fed paper strikes the resist roller pair 28 provided on the upstream side in the transport direction of the transport belt apparatus 110. Then, the paper is sent onto the belt 111 in synchronization with the aforementioned visible image, and reaches the transfer position opposing the photosensitive drum 1 based on the running of the belt. The visible image of the magenta toner is transferred onto the paper at this transfer position by the action of the transfer roller 114 arranged on the back side of the transport belt 111.

In the same way as with the color magenta, visible images based on the various colors of toner are formed on the surfaces of the respective photosensitive drums 1 of the other imaging units SU-b to d, and these visible images are laminated and transferred every time the paper transported by the transport belt 111 arrives at the various transfer positions. Consequently, with the color printer of the present embodiment, full color images are laminated and transferred to paper in nearly as short a time as monochrome images.

On the other hand, for monochrome prints, a black toner visible image is formed on the surface of the photosensitive drum 1 of only the imaging unit SU-d for black, and the Bk toner image is transferred onto the paper sent on top of the belt 111 in synchronization with this Bk visible image.

After the toner image has been transferred the paper is separated from the transport belt 111 and is fixed by a fixing apparatus 136. The fixing apparatus in the present embodiment is a belt fixing system, and has the advantage that the warm up time is shorter than when roller fixing. After fixing is complete, the paper is discharged to a discharge tray 39 provided on the top of the apparatus main body. At this time, the paper is inverted and is discharged with the back side up.

Now then, in this second embodiment, as indicated in FIG. 14, the belt transport unit 120 comprises the transport belt apparatus 110 and the belt cleaning apparatus 115. The belt transport unit 120 has a unit frame 121, and protruding parts 126, 127 are provided at the upper left and lower end positions of this unit frame 121. Then, left and right guide rails 145 and 146 (guide members for first unit) are installed on frames 143 and 144 of the image forming apparatus main body. The aforementioned protruding parts 126 and 127 of the unit frame 121 are supported and guided by the left and right guide rails 145 and 146, and the belt transport unit 120 can be attached to and detached from the apparatus main body. In addition, a sub-guide rail 128 (guide member for second unit), which supports and allows the belt cleaning apparatus 115 to slide, is provided on the unit frame 121, and the belt cleaning apparatus 115 can thereby be attached to and detached from the belt transport unit 120 and the image forming apparatus main body.

In this second embodiment, the belt transport apparatus 110 and the belt cleaning apparatus 115 can be integrally attached to and detached from the apparatus main body based on pulling out and inserting the belt transport unit 120 from the image forming apparatus main body. Further, the present embodiment is configured such that, other than during the image formation operation, the transport belt 111 is separated from the photosensitive drum 1 of the various imaging units.

The belt cleaning apparatus 115 comprises a blade 116 as a cleaning member, and toner and paper dust, etc. removed by the blade 116 is housed in the recovery unit 115*a*. In the present embodiment as well, the belt cleaning apparatus 115 is guided by the sub-guide rail 128 and moves in parallel with the transport belt 111 (in parallel with the rotational axis of the transport belt 111), and therefore, the cleaning apparatus 115 does not tip during detachment, and no toner, etc. drops out from the recovery unit 115*a* (refer to FIG. 14). As is clear from FIG. 14, the opening part of the recovery unit 115*a* (opening part that receives the toner and paper dust scraped off by the cleaning blade 116) is always supported facing upward when the cleaning apparatus 115 is detached, and therefore, no toner, etc. spills from that opening part. Consequently, the cleaning apparatus 15 can be easily detached. In addition, useless contact of the blade 116 and the transport belt 111 can be prevented when detaching the belt cleaning apparatus 115.

Although omitted from the diagram, a lock lever (lock member for second unit) to lock the withdrawal of the belt cleaning apparatus 115 and a lock mechanism (lock member for first unit) to lock the withdrawal of the belt transport unit 120 (transport belt apparatus 110) are provided in the same way as in the aforementioned first embodiment. Moreover, the cleaning blade 116 and the transport belt 111 are similarly configured to make contact and separate by connecting to the rotation of the lock lever (switching of the lever) that locks the withdrawal of the belt cleaning apparatus 115.

Moreover, detection means (first unit detection means) for detecting that the intermediate transfer apparatus 110 (intermediate transfer unit 120) has been set up in the apparatus main body may also be provided in the same way as in the aforementioned first embodiment. Further, it is suitable to provide detection means (sensor 55) (second unit detection means) to detect that the cleaning apparatus 115 has been set up in the apparatus main body As described above, in this second embodiment the intermediate transfer apparatus 110 and the cleaning apparatus 115 can be attached to detached from the apparatus main body in a single unit as the intermediate transfer unit 120, and the cleaning apparatus 115 can be independently attached to and detached from the apparatus main body while the intermediate transfer apparatus 110 remains mounted on the apparatus main body. Consequently, a plurality of attachable and detachable units can be easily attached to and detached from the apparatus main body, and maintenance operations are easy. When replacing the cleaning member (cleaning blade 116 in the present embodiment), which generally has a shorter operational life than the intermediate transfer belt, the entire intermediate transfer unit 120 does not have to be removed, and the operation is easy. Naturally, the cleaning apparatus 115 can also be removed after removing the intermediate transfer unit 120 from the apparatus main body.

In addition, it is possible to remove the intermediate transfer unit 120 after the cleaning apparatus 115 has been removed, and it is also possible to mount the cleaning apparatus 115 after the intermediate transfer unit 120 has been mounted in the apparatus main body.

Then, because the direction of attachment and detachment of the intermediate transfer apparatus 110 (intermediate transfer unit 120) is the same as that of the cleaning apparatus 115, the attachment and detachment operation is easy. In the present embodiment, the directions of attachment and detachment of the intermediate transfer apparatus 110 (intermediate transfer unit 120) and the cleaning apparatus 115 are set up in the front to back direction of the image forming apparatus, and therefore the intermediate transfer apparatus 110 (intermediate transfer unit 120) and the cleaning apparatus 115 can be easily attached to and detached from the front of the apparatus, and this is an advantage in terms of the installation location of the apparatus.

Moreover, because the directions of attachment and detachment of the intermediate transfer apparatus 110 (intermediate transfer unit 120) and the cleaning apparatus 115 are parallel to the rotational axis of the intermediate transfer belt 111, the configuration whereby the intermediate transfer apparatus 110 (intermediate transfer unit 120) and the cleaning apparatus 115 are supported to enable attachment and detachment, for example, the method of installing guide rails, is simplified.

Next, a third embodiment configured to enable attachment and detachment of just the second unit with the first unit remaining mounted in the apparatus main body will be explained. The basic configuration of this third embodiment is the same as that of the first embodiment previously explained using FIGS. 1 to 12, and therefore, redundant explanations will be omitted, and the parts that differ will be explained.

Figures 15A, 15B:
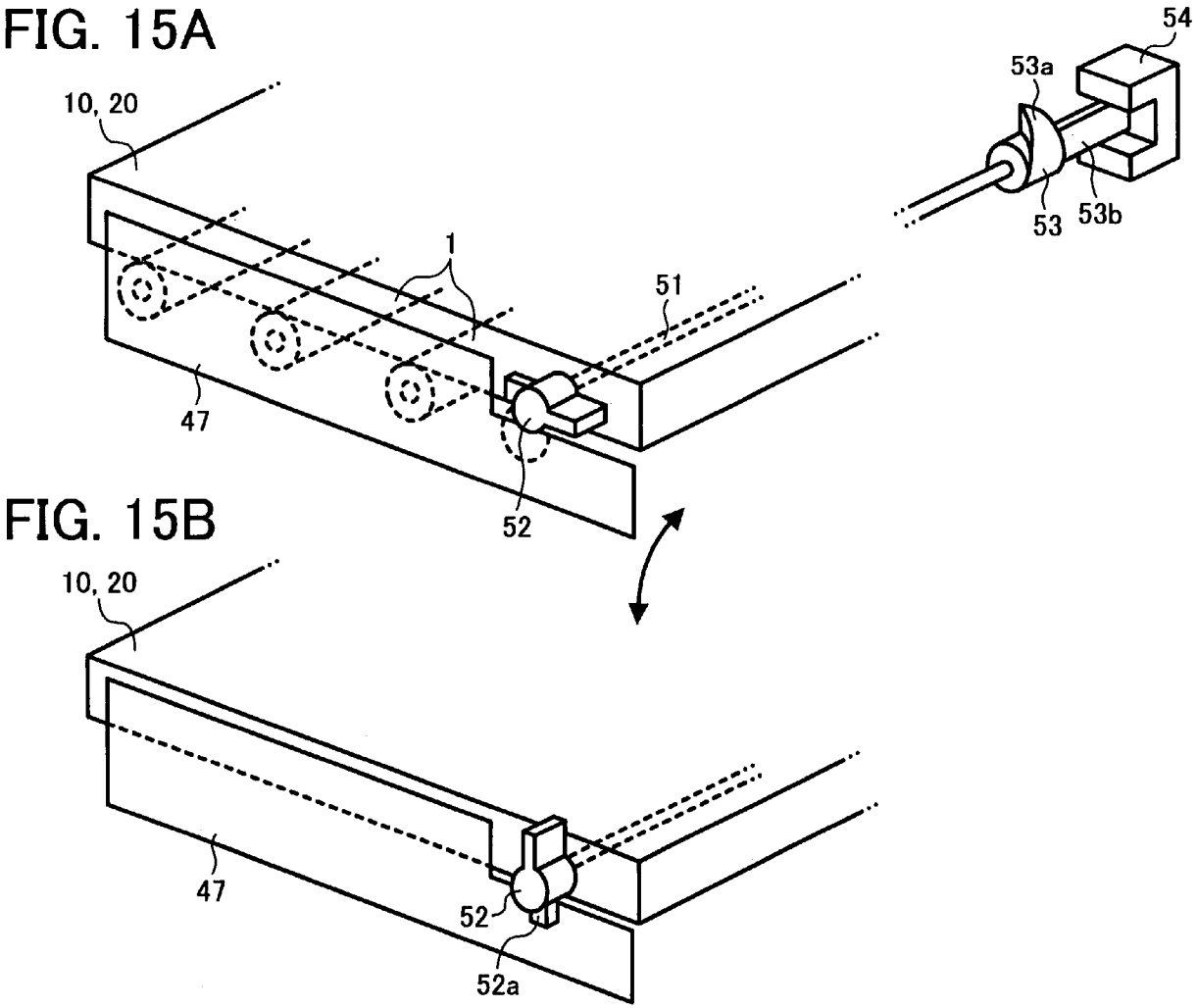
FIGS. 15A and 15B are pattern diagrams indicating characteristic parts of an image forming apparatus of a third embodiment of the present invention.
Figure 16:
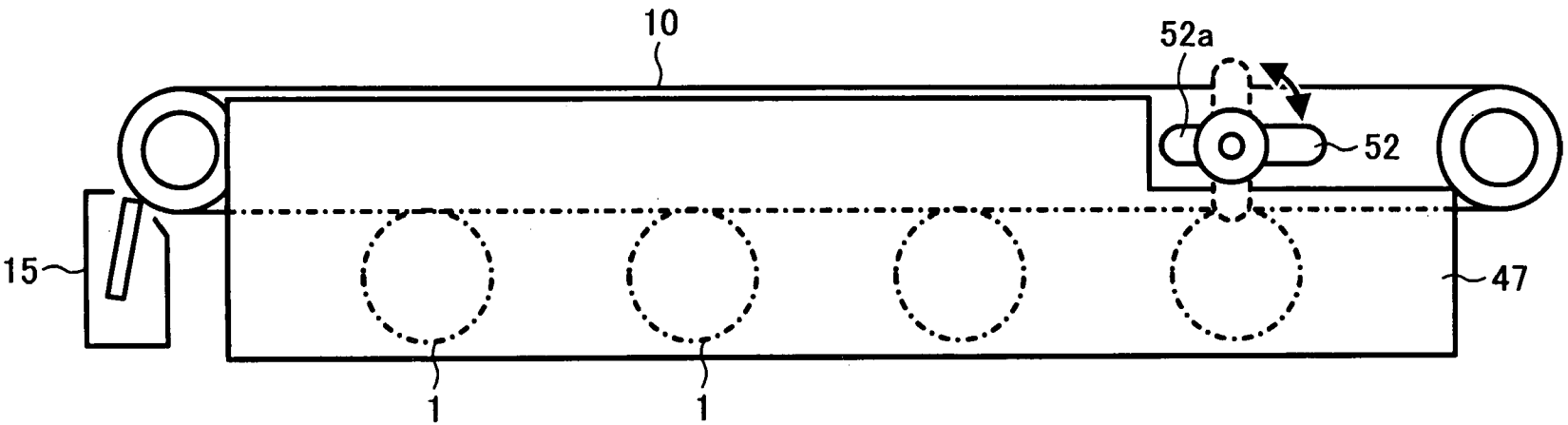
FIG. 16 is a front view diagram indicating the positional relationship of the face plate of the photosensitive member and the cleaning apparatus of the same embodiment.

As indicated in FIGS. 15A, 15B, and 16, the width of the photosensitive member plate 47 (in the width direction of the apparatus) is not large enough to cover the cleaning apparatus 15 when viewed from the front of the apparatus, and the cleaning apparatus 15 can be detached even with the photosensitive member plate 47 closed. Specifically, the cleaning apparatus 15 is configured to enable detachment in relation to the intermediate transfer apparatus 10 and the image forming apparatus main body with the photosensitive member plate 47 closed and the lock lever 52 rotated to the lock position (phantom lines in FIG. 16) (with the lock means locked). The high frequency maintenance operations of pulling out and installing the cleaning apparatus 15 can thereby be conducted without removing either the intermediate transfer apparatus 10 or the intermediate transfer unit 20, thus making the operation easy. In addition, even when replacing the cleaning blade 16, which has a shorter operational life than the intermediate transfer belt 11, the operation can be conducted without removing either intermediate transfer apparatus 10 or the intermediate transfer unit 20 from the image forming apparatus main body, and labor is saved.

In this way, the third embodiment makes the operation even easier because the cleaning apparatus 15 can be attached to and detached from the intermediate transfer apparatus 10 and the image forming apparatus main body even when the photosensitive member plate 47 is closed and the lock lever 52 is rotated to the lock position, specifically, even when the intermediate transfer apparatus 10 cannot be detached and is locked by the plate 47 and the lock member 53 provided on the rear end of the rotational spindle of the lock lever 52.

Next, a fourth embodiment will be explained that prevents the dropping of the unit when replacing units, and improves handling characteristics when replacing (detaching) units. The basic configuration of this fourth embodiment is the same as that of the first embodiment previously explained using FIGS. 1 to 12B, and therefore, redundant explanations will be omitted, and the parts that differ will be explained.

The configuration of the frame of the image forming apparatus main body is as indicated in FIG. 2. Then, as indicated in FIG. 3, the left and right guide rails 45 and 46 support from both sides and guide the intermediate transfer apparatus 10 to enable movement in the axial direction of the support rollers 12 and 13 (FIG. 1) of the intermediate transfer belt 11. The intermediate transfer apparatus 10 can thereby be detached from the front of the apparatus main body.

The part with the cleaning apparatus 15 mounted is enlarged in FIG. 4. As indicated in this diagram, the cleaning apparatus 15 is supported on both the top and bottom by the upper rail 49 and the lower rail 50, and can slide. In this fourth embodiment, the upper rail 49 and the lower rail 50 are both configured to be supported by the intermediate transfer apparatus 10 (by the frame of the intermediate transfer apparatus 10 not indicated in the diagram). By both the upper rail 49 and the lower rail 50, which support and enable attachment and detachment of the cleaning apparatus 15, being supported by the intermediate transfer apparatus 10 (secured to the frame of the intermediate transfer apparatus 10 not indicated in the diagram), even supposing dimensional error between the intermediate transfer apparatus 10 and the apparatus main body, that dimensional error will not influence the guide members (upper rail 49 and lower rail 50) that support the cleaning apparatus 15, the cleaning apparatus 15 will not come off of either the upper rail 49 or the lower rail 50, and dropping of the unit can be reliably prevented. Further, the upper rail 49 is positioned between the left guide rail 45 and the cleaning apparatus 15 on top and bottom (refer to FIG. 7), and is slid on the left guide rail 45 when attaching and detaching the intermediate transfer apparatus 10 (intermediate transfer unit 20). Specifically, the upper rail 49 is a guide member in relation to the cleaning apparatus 15, and is a guided member (moving member) in relation to the left guide rail 45.

Another example of a possible configuration is to secure the upper rail 49 to the left guide rail 45 or to form the upper rail 49 and the left guide rail 45 into a single unit, and then to secure the lower rail 50 to the frame of the intermediate transfer apparatus 10 not indicated in the diagram. This is a configuration in which only one (lower rail 50) of the two rails that support the cleaning apparatus 15 is supported by the intermediate transfer apparatus 10, but because the lower rail 50 receives the majority of the weight of the cleaning apparatus 15, even supposing a dimensional error between the intermediate transfer apparatus 10 and the apparatus main body, there is little danger of the cleaning apparatus 15 falling during detachment. In addition, by securing the upper rail 49 to the left guide rail 45 or forming into a single unit with the left guide rail 45, the configuration of that part can be simplified, the number of parts decreased, and the costs reduced.

The present invention was explained above by the various embodiments in the diagrams, but the present invention is not limited to these.

For example, the form of tensioning the intermediate transfer belt or the transport belt (transfer belt) as well as the configuration of the guide rails, etc. could be suitably established. Moreover, the configuration of the cleaning apparatus is not limited to a blade system, and optional systems such as a cleaning roller or cleaning brush could be adopted.

Moreover in addition to the intermediate transfer belt and transport belt (transfer belt) cited in the examples and diagrams, the rotational member rotatably supported in the detachable first unit may also be an image support member such as a photosensitive member.

The configuration of the imaging units and the configuration of the fixing apparatus are also optional. Naturally, the image forming apparatus is not limited to a printer, and may also be a facsimile machine, copier or combinations thereof.

The following notable effects are obtained with the image forming apparatus of the present invention described above.

(1) It is possible to attach and detach the first and second units integrally to and from the apparatus main body; it is also possible to attach and detach only the second unit while the first unit remains mounted in the apparatus main body; and because in both cases detachment can be conducted in the same direction, the units can be easily attached to and detached from the apparatus main body.

(2) Moreover, by providing detection means to detect the installation status of the various units, operation without a unit mounted can be prevented and accidents by mistaken operation can be avoided before they happen.

(3) The second unit that is the cleaning apparatus is guided in the axial direction of the support roller of the belt member and can be attached to and detached from the apparatus main body or the first unit, and therefore the second unit will not tip over when detaching, and dropping toner, etc. from the recovery part can be prevented.

(4) The second unit can be locked to the first unit using the lock means, and therefore moving or dropping the second unit can be prevented and breakdown or damage to the apparatus can be avoided.

(5) The cleaning member is separated from the belt member by releasing the lock of the lock means, and therefore there is no rubbing on the belt member when detaching the cleaning apparatus, and damage to the belt member can be avoided.

(6) The cleaning unit contacts the belt member based on the locking of the lock means, and therefore the labor of moving the cleaning member after the cleaning apparatus has been mounted can be omitted.

(7) The cleaning apparatus can be easily attached to and detached from the intermediate transfer belt, the transfer transport belt or the image support member.

(8) If only the second unit is detached with the first unit remaining mounted on the apparatus main body, releasing the lock means is not necessary and the operation is easy.

(9) The second unit can be attached and detached independently with the lock means locked, specifically, with the belt member and the image support member making contact.

(10) The lock and lock release of the lock means and the contact and separation of the belt member and the image support member can be linked.

(11) Rubbing of the belt member and the image support member can be prevented when detaching the first unit. Moreover, the configuration for supporting and enabling first unit attachment and detachment, for example, the method of installing the guide rails, is simplified.

(12) The second unit can be easily attached to and detached from the first unit which includes the intermediate transfer belt.

(13) Attachment and detachment of the first unit can be restricted by a face plate that can move to a restriction position and to a retracted position, and be reliably locked.

(14) The movement of the face plate can be restricted and reliably locked because the face plate can be retained and released.

(15) The cleaning apparatus that cleans the belt member can be easily attached and detached.

(16) The second lock means can lock the second unit to the first unit, and therefore movement and detachment of the second unit can be prevented, and accidents and damage to the apparatus can be avoided.

(17) Releasing the lock of the second lock means separates the cleaning member from the belt member, and therefore the cleaning apparatus does not rub on the belt member during detachment, and damage to the belt member can be avoided.

(18) Locking the second lock means makes the cleaning member contact the belt member, and therefore the labor of moving the cleaning member after mounting the cleaning apparatus can be omitted.

(19) The direction of detaching the second unit is the axial direction of a roller member that supports the belt member, and therefore rubbing of the second unit on the belt member during detachment can be avoided. Moreover, the configuration for attachably and detachably supporting the second unit such as the method of installing the guide rails, is simplified.

(20) In the configuration in which two guide members retaining from both sides and supporting the second unit to enable attachment and detachment are attached to the first unit, the second unit can be reliably supported and dropping of the second unit during detachment can be prevented irrespective of the dimensional error between the first unit and the apparatus main body is unrelated.

(21) In the configuration in which one of the guide members that supports the second unit is installed on the apparatus main body, a simple configuration can be established for both the support and guide part of the second unit.

(22) The configuration of the guide part can be simplified by mounting or forming into a single unit one of the guide members supporting the second unit and one of the guide members for the first unit; and the number of parts can also be decreased and costs can be controlled.

(23) The method of installing the guide member that supports the first and second units enabling attachment and detachment is simplified.

(24) The cleaning apparatus that cleans the belt member can be easily attached and detached.

(25) The second unit can be easily attached to and detached from the first unit which includes the intermediate transfer belt.

Various modifications will become possible for those skilled in the art after receiving the teachings of the present disclosure without departing from the scope thereof.

What is claimed is:

1. An image forming apparatus, comprising:

a first unit configured to be attached to and detached from an apparatus main body;

a second unit configured to be attached to and detached from the first unit; wherein the second unit is configured to be attached to and detached from the apparatus main body integrally with the first unit, and is further configured to be attached to and detached from the first unit with the first unit remaining mounted in the apparatus main body;

two guide members for the second unit, with one attached to the apparatus main body and the other attached to the first unit, that retain from both sides and are configured to support the second unit to enable attachment and detachment; and a plurality of guide members for the first unit that are configured to be attached to the apparatus main body, and retain from both sides and support the first unit to enable attachment and detachment, wherein one of the guide members that supports the second unit is mounted on one of the guide members for the first unit, or is formed integrally with one of the guide members for the first unit.

2. The image forming apparatus as claimed in claim 1, wherein directions of detaching the first unit and the second unit are the same.

3. The image forming apparatus as claimed in claim 1, wherein the first unit is configured to be attached to and detached from the apparatus main body with the second unit removed.

4. The image forming apparatus as claimed in claim 1, further comprising a first detection unit configured to detect that the first unit is mounted in or removed from the apparatus main body, and a second detection unit configured to detect that the second unit is mounted in or removed from the apparatus main body.

5. The image forming apparatus as claimed in claim 1, wherein the first unit has a rotatable belt member, and the detachment direction of the first and second units is the axial direction of a support roller of the belt member.

6. The image forming apparatus as claimed in claim 5, wherein the belt member is an intermediate transfer belt.

7. The image forming apparatus as claimed in claim 5, wherein the belt member is a transfer transport belt.

8. The image forming apparatus as claimed in claim 5, wherein the second unit is a cleaning apparatus configured to clean the belt member.

9. The image forming apparatus as claimed in claim 1, wherein the first unit has a rotatably supported rotating body;

the second unit is a cleaning apparatus having a cleaning member configured to contact the rotating body, and a recovery unit that houses recovered substances the cleaning member has cleaned off; and the second unit is configured to be attached to and detached from the apparatus main body and the first unit by being guided in the axial direction of the rotating body with the first unit remaining mounted on the apparatus main body.

10. The image forming apparatus as claimed in claim 9, wherein the rotating body is an intermediate transfer belt.

11. The image forming apparatus as claimed in claim 9, wherein the rotating body is a transfer transport belt.

12. The image forming apparatus as claimed in claim 9, wherein the rotating body is an image support member.

13. The image forming apparatus as claimed in claim 9 further comprising a second unit lock member configured to lock the second unit to the first unit, wherein when the lock of the second unit lock member is released, the second unit is configured to be attached to and detached from the first unit and the apparatus main body.

14. The image forming apparatus as claimed in claim 13, wherein the cleaning member is configured to be separated from the rotating body by releasing the lock of the second unit lock member.

15. The image forming apparatus as claimed in claim 14, wherein the cleaning member is configured to contact the rotating body by locking the second unit lock member.

16. The image forming apparatus as claimed in claim 1 further comprising a first unit lock member configured to restrict the attachment and detachment of the first unit, wherein the second unit is configured to be attached to and detached from the apparatus main body integrally with the first unit when a lock is released by the first unit lock member, and is configured to be attached to and detached from the apparatus main body and the first unit with the first unit lock member locked.

17. The image forming apparatus as claimed in claim 16, wherein the first unit has a rotatable belt member;

the belt member is configured to contact and be separated from an image support member arranged in the apparatus main body; and the belt member and the image support member are configured to make contact when the first unit lock member is in the locked state.

18. The image forming apparatus as claimed in claim 17, wherein the first unit detachment direction is the axial direction of a roller member that supports the belt member.

19. The image forming apparatus as claimed in claim 17, wherein the belt member is an intermediate transfer belt.

20. The image forming apparatus as claimed in claim 17, wherein the second unit is a cleaning apparatus that cleans the belt member.

21. The image forming apparatus as claimed in claim 20 further comprising a second unit lock member configured to lock the second unit to the first unit, wherein the second unit is configured to be attached to and detached from the first unit and the apparatus main body when the lock of the second unit lock member is released;

the cleaning apparatus has a cleaning member configured to contact the belt member; and the cleaning member is configured to be separated from the belt member by releasing the lock of the second unit lock member.

22. The image forming apparatus as claimed in claim 21, wherein the cleaning member is configured to contact the belt member by locking the second unit lock member.

23. The image forming apparatus as claimed in claim 17, wherein the second unit detachment direction is the axial direction of a roller member that supports the belt member.

24. The image forming apparatus as claimed in claim 16, wherein the first unit lock member has a face plate configured to move between a restriction position that restricts the attachment and detachment of the first unit, and a retracted position that does not restrict the attachment and detachment.

25. The image forming apparatus as claimed in claim 24, wherein the first unit lock member has a face plate retention member that is configured to move to a retention position that retains the face plate in the restriction position and to a release position that releases retention.

26. The image forming apparatus as claimed in claim 16, further comprising a second unit lock member configured to lock the second unit to the first unit, wherein when the lock of the second unit lock member is released, the second unit is configured to be attached to and detached from the first unit and the apparatus main body.

27. The image forming apparatus as claimed in claim 1, wherein the first unit has a rotatable belt member;

the belt member is configured to contact and be separated from an image support member arranged on the apparatus main body; and the belt member and the image support member are configured to make contact by locking a first unit lock member, and the belt member is configured to be separated from the image support member by releasing the lock of the first unit lock member.

28. The image forming apparatus as claimed in claim 27, wherein the direction of detachment of the first unit is the axial direction of a roller member that supports the belt member.

29. The image forming apparatus as claimed in claim 27, wherein the belt member is an intermediate transfer belt.

30. The image forming apparatus as claimed in claim 27, wherein the second unit is a cleaning apparatus that cleans the belt member.

31. The image forming apparatus as claimed in claim 30, further comprising a second unit lock member configured to lock the second unit to the first unit, wherein the second unit is configured to be attached to and detached from the first unit and the apparatus main body when the lock of the second unit lock member is released;

the cleaning apparatus has a cleaning member to contact the belt member; and the cleaning member is configured to be separated from the belt member by releasing the lock of the second unit lock member.

32. The image forming apparatus as claimed in claim 31, wherein the cleaning member is configured to contact the belt member by locking the second unit lock member.

33. The image forming apparatus as claimed in claim 27, wherein the detachment direction of the second unit is the axial direction of a roller member that supports the belt member.

34. The image forming apparatus as claimed in claim 1 further comprising two guide members for the second unit that are attached to the first unit, retain from both sides and support the second unit to enable attachment and detachments.

35. The image forming apparatus as claimed in claim 34, wherein the first unit has a rotatable belt member, and the directions of detaching the first and second units is an axial direction of a support roller of the belt member.

36. The image forming apparatus as claimed in claim 35, wherein the belt member is an intermediate transfer belt.

37. The image forming apparatus as claimed in claim 34, wherein the first unit has a rotatable belt member, and the second unit is a cleaning apparatus that cleans the belt member.

38. The image forming apparatus as claimed in claim 37, wherein the belt member is an intermediate transfer belt.

39. The image forming apparatus as claimed in claim 1, wherein the first unit has a rotatable belt member, and the directions of detaching the first and second units is an axial direction of a support roller of the belt member.

40. The image forming apparatus as claimed in claim 39, wherein the belt member is an intermediate transfer belt.

41. The image forming apparatus as claimed in claim 1, wherein the first unit has a rotatable belt member, and the second unit is a cleaning apparatus that cleans the belt member.

42. The image forming apparatus as claimed in claim 41, wherein the belt member is an intermediate transfer belt.

* * * * *